US007503822B2

(12) United States Patent
Sekiya

(10) Patent No.: US 7,503,822 B2
(45) Date of Patent: Mar. 17, 2009

(54) ELECTRON-EMITTING DEVICE MANUFACTURING APPARATUS

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 494 days.

(21) Appl. No.: 11/333,684

(22) Filed: Jan. 17, 2006

(65) Prior Publication Data

US 2006/0172651 A1 Aug. 3, 2006

Related U.S. Application Data

(62) Division of application No. 10/693,505, filed on Oct. 23, 2003, now Pat. No. 7,084,559.

(30) Foreign Application Priority Data

Oct. 23, 2002 (JP) ..... 2002-308144
Sep. 24, 2003 (JP) ..... 2003-331325

(51) Int. Cl.
*H01J 9/24* (2006.01)

(52) U.S. Cl. ..... 445/24

(58) Field of Classification Search ..... 445/24, 445/25

See application file for complete search history.

(56) References Cited

U.S. PATENT DOCUMENTS 3,060,429 A 10/1962 Winston
3,298,030 A 1/1967 Lewis et al.
3,416,153 A 12/1968 Hertz et al.
3,596,275 A 7/1971 Sweet
3,747,120 A 7/1973 Stemme
5,066,883 A 11/1991 Yoshiaka et al.
5,610,637 A 3/1997 Sekiya et al.
5,657,060 A 8/1997 Sekiya et al.
5,729,257 A 3/1998 Sekiya et al.
5,877,786 A 3/1999 Sekiya et al.
6,039,425 A 3/2000 Sekiya et al.
6,193,348 B1 2/2001 Sekiya et al.
6,227,639 B1 5/2001 Sekiya et al.
6,270,389 B1 * 8/2001 Kobayashi et al. ..... 445/24
6,338,545 B1 1/2002 Sekiya
6,426,733 B1 7/2002 Yamada (Continued)

FOREIGN PATENT DOCUMENTS

JP 64031332 2/1989

(Continued)

*Primary Examiner*—Toan Ton
*Assistant Examiner*—Hana A Sanei
(74) *Attorney, Agent, or Firm*—Cooper & Dunham, LLP.

(57) ABSTRACT

In an electron-emitting device manufacturing apparatus for forming a surface conduction electron-emitting element by a conductive thin film, a discharge head of a piezo-jet type using a piezoelectric element has a diameter being equal to or less than $\phi 25$ μm and jets a solution that includes metal micro-particle material for forming the conductive thin film, on the area between the electrodes, which are formed on a substrate of the electron-emitting device, as a droplet. A volatile component in a solution dot pattern is vaporized after the droplet is jetted on the substrate so that a solid content is remained on the substrate. The solution having micro-particle dispersed in liquid satisfies a relationship of $0.0002 \leqq Dp/Do \leqq 01$ where Dp denotes a diameter of the metal micro-particle and Do denotes a diameter of the discharge opening.

7 Claims, 26 Drawing Sheets

U.S. PATENT DOCUMENTS

| | | | | |
|---|---|---|---|---|
| 6,443,565 | B2 * | 9/2002 | Fujii | 347/65 |
| 6,554,401 | B2 | 4/2003 | Sekiya | |
| 6,568,778 | B1 | 5/2003 | Sekiya | |
| 6,598,959 | B2 | 7/2003 | Sekiya | |
| 6,764,174 | B2 | 7/2004 | Sekiya | |
| 6,789,866 | B2 | 9/2004 | Sekiya et al. | |
| 6,871,940 | B2 | 3/2005 | Sekiya | |
| 6,918,666 | B2 | 7/2005 | Sekiya | |
| 2001/0024227 | A1 | 9/2001 | Sekiya | |
| 2002/0122098 | A1 | 9/2002 | Sekiya | |
| 2003/0053501 | A1 | 3/2003 | Sekiya et al. | |
| 2003/0058301 | A1 | 3/2003 | Sekiya | |
| 2003/0085948 | A1 | 5/2003 | Sekiya | |
| 2004/0001418 | A1 | 1/2004 | Shinotsuka et al. | |

FOREIGN PATENT DOCUMENTS

| | | | |
|---|---|---|---|
| JP | 01283749 | | 11/1989 |
| JP | 02257552 | | 10/1990 |
| JP | 2000-211124 | | 8/2000 |
| JP | 2000211124 | A * | 8/2000 |
| JP | 2000-311581 | | 11/2000 |
| JP | 2001-222945 | | 8/2001 |
| JP | 2001-307622 | | 11/2001 |
| JP | 2001319567 | | 11/2001 |

* cited by examiner

ELECTRON-EMITTING DEVICE MANUFACTURING APPARATUS

CROSS-REFERENCE TO RELATED APPLICATION

This application is a divisional of U.S. Ser. No. 10/693,505, filed Oct. 23, 2003 now U.S Pat. No. 7,084,559, the entire contents of which are herein incorporated by reference.

BACKGROUND

1. Technical Field

This disclosure generally relates to an electron-emitting device manufacturing apparatus using a surface conduction electron-emitting element, a solution used for the electron-emitting device manufacturing apparatus and an electron-emitting device manufactured by using the solution, and an image displaying apparatus using the electron-emitting device.

2. Description of the Related Art

Conventionally, two types of a thermoelectric source and cold cathode electronic source are known as an electron emitting device. A field emission type (hereinafter, called FE type), a metal/insulating layer/metal form (hereinafter, called MIM type), and a surface conduction electron-emitting element are known as the cold cathode electronic source. As example of the FE type, "W. P. Dyke & W. W. Dolan, "Field emission", Advance in Electron Physics, 8 89 (1956)" (reference 12) and "C. A. Spindt, "Physical Properties of thin-film fieldemission cathodes with molybdenium" J. Appl. Phys., 475248 (1976)" (reference 13) are known. As an example of the MIM type, "C. A. Mead, "The Tunnel-emission amplifier", J. Appl. Phys., 32 646 (1961)" (reference 14) is known.

As an example of the surface conduction electron-emitting element type, "M. I. Elinson, Radio Eng. Electron Phys., 1290 (1965)" (reference 15) is known. By applying a current to emulsion side in parallel on a thin film on a small area formed on a substrate, the surface conduction electron-emitting element causes electron emission. That phenomenon is utilized. As the surface conduction electron-emitting element, use of a $SnO_2$ thin film is disclosed by Elinson, use of an Au thin film is disclosed in "G. Dittmer, "Thin SolidFilms", 9 317 (1972)" (reference 16), use of $In_2O_3/SnO_2$ thin film is disclosed in "M. Hartwell and C. G. Fonstad, "IEEETrans.ED Conf.", 519 (1975)" (reference 17), and use of a carbon thin film is disclosed in "Hisashi Araki et all, "Vacuum", vol. 26, no. 1, page 22, (1983)" (reference 18).

As a typical element configuration, an element configuration disclosed by M. Hartwell described above is shown in FIG. 1. In FIG. 1, the element configuration of M. Hartwell includes a substrate 1, electrodes 2 and 3, a conductive thin film 4, and an electron emitting part 5. The conductive thin film 4 is made from a metal oxide thin film formed by a spatter in a pattern of an H shape, and the electron emitting part 5 is formed by an electric process called an electric forming (described later). In FIG. 1, a length L1 between the electrodes 2 and 3 is defined to be from 0.5 mm to 1 mm, and a Width W1 is defined to be 0.1 mm.

In the conventional surface conduction electron-emitting element, the electron emitting part 6 is generally formed by conducting the electric process called the electric forming with respect to the conductive thin film 4 before the electron emission is conducted. In the electric forming, a DC voltage or enormously slow rising voltage, for example, approximate 1V/min is applied to both ends of the conductive thin film 4, and then the conductive thin film 4 is locally violated, transformed, or degenerated, so that the electron emitting part 5 is formed in a state being electrically a high resistance. At the electron emitting part 5, the conductive thin film 4 is partially cracked, and the electrons are emitted from that crack. The surface conduction electron-emitting element to which an electric forming process is conducted applies a voltage to the conductive thin film 4, and applies a current to the element, so that the electron emitting part 5 emits electrons.

Advantageously, since the above-described surface conduction electron-emitting element can be easily manufactured because of its simple configuration, a plurality of elements can be arranged and formed in a larger area. Applied researches have been conducted for a charged beam source a display unit, or a like by taking advantages of the above-described features. As an example in that a plurality of surface conduction electron-emitting elements are arranged and formed, as described later, the surface conduction electron-emitting elements are arranged in parallel called a quarter line arrangement, and both ends of each element are wired (called a consensus sequence) and a cross-lined row is arranged in multiple lines in the electronic source (for example, see references 1-3).

Moreover, in an image forming apparatus as the display unit or a like, recently, a tabular type display unit using a liquid crystal has been spread instead of a CRT (Cathode Ray Tube). However, there is a problem in that the tabular type display unit is required to have a backlight because the tabular type display is not a self-luminous type. Thus, it has been desired to develop the display unit of self-luminous type. As a self-luminous type display unit, an image forming apparatus is disclosed as the display unit combining the electronic source arranging the plurality of the surface conduction electron-emitting elements and a fluorescent material emitting a visible light by the electron emitted from the electronic source (for example, see the reference 4).

However, in the conventional surface conduction electron-emitting device manufacturing method, a photolithography etching method in a vacuum deposition and a semiconductor process is frequently used, and in order to form the elements in the larger area, a large number of steps and higher production cost are required to produce the electron-emitting device.

As for the above-described problems, in order to form the conductive thin film of a device part of the surface conduction electron-emitting element as described above, without depending on a vacuum deposition method and a photolithography etching method, the inventor considers to form the conductive thin film at a stable preferable yield ratio and a low cost by applying an ink-jet droplet providing means known as U.S. Pat. No. 3,060,429 (reference 5), Japanese Laid-open Patent Application No. 3298030 (reference 6), Japanese Laid-open Patent Application No. 3596275 (reference 7), Japanese Laid-open Patent Application No. 3416153 (reference 8), Japanese Laid-open Patent Application No. 3747120 (reference 9), and Japanese Laid-open Patent Application No. 5729257 (reference 10). Then, the inventor discloses a result of studying a practical producing method in a broad range in Japanese Laid-open Patent Application No. 2001-319567 (reference 11).

However, there are still various unsolved problems in order to stably jet and provide a solution including an element to be the conductive thin film on the substrate because of differences from a method for jetting an ink toward a paper sheet and a method for recording by an ink-jet. For example, since such this element is generally a metal element, there are still unknown parts in technologies of successively stably jetting for a long term. Especially, in order to make a jet performance stable for a long term, a clogging problem should be solved.

Conventionally, in a field of an ink-jet record using a record liquid in which a water soluble dye is dissolved, a nozzle of a head is generally from a range from Φ33 μm to Φ34 μm (approximate 900 $\mu m^2$ in area) to a range from Φ50 μm to Φ51 μm (approximate 2000 $\mu m^2$ in area), and a dye is dissolved in a liquid medium. Accordingly, the clogging problem is eliminated. However, even such conventional technology cannot solves the clogging problem in a condition of stably jetting the ink from a minute nozzle, for example, under Φ25 μm (smaller than 500 $\mu m^2$ in area) which does not exist in the conventional technology, for a long term.

REFERENCE LIST

[Reference 1]
Japanese Laid-open Patent Application No. 64-31332
[Reference 2]
Japanese Laid-open Patent Application No. 1-283749
[Reference 3]
Japanese Laid-open Patent Application No. 2-257552
[Reference 4]
U.S. Pat. No. 5,066,883
[Reference 5]
U.S. Pat. No. 3,060,429
[Reference 6]
U.S. Pat. No. 3,298,030
[Reference 7]
U.S. Pat. No. 3,596,275
[Reference 8]
U.S. Pat. No. 3,416,153
[Reference 9]
U.S. Pat. No. 3,747,120
[Reference 10]
U.S. Pat. No. 5,729,257
[Reference 11]
United State Patent No. 2001-319567
[Reference 12]
W. P. Dyke & W. W. Dolan, "Field emission", Advance in Electron Physics, 8 89 (1956)
[Reference 13]
C. A. Spindt, "Physical Properties of thin-film fieldemission cathodes with molybdenium" J. Appl. Phys., 475248 (1976)
[Reference 14]
C. A. Mead, "The Tunnel-emission amplifier", J. Appl. Phys., 32 646 (1961)
[Reference 15]
M. I. Elinson, Radio Eng. Electron Phys., 1290 (1965)
[Reference 16]
G. Dittmer, "Thin SolidFilms", 9 317 (1972)
[Reference 17]
M. Hartwell and C. G. Fonstad, "IEEETrans.ED Conf.", 519 (1975)
[Reference 18]
"Hisashi Araki et all, "Vacuum", vol. 26, no. 1, page 22, (1983)"

SUMMARY OF THE INVENTION

Generally, there is provided in this disclosure an electron-emitting device manufacturing apparatus using a surface conduction electron-emitting element, a solution used for the electron-emitting device manufacturing apparatus and an electron-emitting device manufactured by using the solution, and an image displaying apparatus using the electron-emitting device.

In a first aspect of this disclosure, there is provide an electron-emitting device manufacturing apparatus that can be stably used without any clogging for a long time when the solution is jetted.

In a second aspect of this disclosure, there is provided an electron-emitting device manufacturing apparatus that can be stably used without clogging for a long term when the solution is jetted.

In a third aspect of this disclosure, there is provided a solution including metal micro-particle material used for an electron-emitting device manufacturing apparatus in that it is possible to form the electron emitting device having a minute and favorable pattern and to realize a novel solution including the metal micro-particles that can be stably used without clogging for a ling time when the solution is jetted.

In a fourth aspect of this disclosure, there is provided a solution including metal micro-particle material used for an electron-emitting device manufacturing apparatus in that it is possible to form the electron emitting device having a minute and favorable pattern and to realize a novel solution including the metal micro-particles that can be stably used without clogging for a long time when the solution is jetted.

In a fifth aspect of this disclosure, there is provided an electron-emitting device that can conduct a preferable electron emission so as to form the electron emitting device at higher grade.

In a sixth aspect of this disclosure, there is provided an image displaying apparatus having a high quality, a high precision, a high reliability, a high image quality, a high grade, and a high durability.

In an exemplary embodiment of this disclosure, there is provided an electron-emitting device manufacturing apparatus for forming a surface conduction electron-emitting element by a conductive thin film, the electron-emitting device manufacturing apparatus including: a discharge head of a piezo-jet type using a piezoelectric element, the discharge head having discharge opening, the diameter of which is equal to or less than ϕ25 μm, and jetting a solution that includes metal micro-particle material for forming the conductive thin film, and the discharge head jetting the solution on the area between the electrodes, which are formed on a substrate of the electron-emitting device, as a droplet and vaporizing a volatile component in a solution dot pattern after the droplet is jetted on the substrate so that a solid content is remained on the substrate, wherein the solution having micro-particle dispersed in liquid satisfies a relationship of $0.0002 \leqq Dp/Do \leqq 0.01$ where Dp denotes a diameter of the metal micro-particle and Do denotes a diameter of the discharge opening.

In another exemplary embodiment of this disclosure, there is provided an electron-emitting device manufacturing apparatus for forming a surface conduction electron-emitting element by a conductive thin film, the electron-emitting device manufacturing apparatus including: a discharge head of a thermal-jet type using a heating element, the discharge head having a discharge opening, the diameter of which is equal to or less than ϕ25 μm, and jetting a solution that includes the metal micro-particle material for forming the conductive thin film, and the discharge head jetting the solution on the area between the electrodes, which are formed on a substrate of the electron-emitting device, at a speed between 6 m/s and 18 m/s and vaporizing a volatile component in a solution dot pattern after the droplet is jetted on the substrate so that a solid content is remained on the substrate, wherein the solution having micro-particle dispersed in liquid satisfies a relationship of 0.0002≦Dp/Do≦0.01 where Dp denotes a diameter of the metal micro-particle and Do denotes a diameter of the discharge opening.

In another exemplary embodiment of this disclosure, there is provided a solution including metal micro-particle material used for an electron-emitting device manufacturing apparatus that manufactures a surface conduction electron-emitting element by a conductive thin film, the electron-emitting device manufacturing apparatus having a discharge head of a piezo-jet type using a piezoelectric element, and the discharge head having discharge opening, the diameter of which is equal to or less than ϕ25 μm, and jetting a solution including the metal micro-particle material for forming the conductive thin film, and the discharge head jetting the solution on the area between the electrodes, which are formed on a substrate of the electron-emitting device, as a droplet and vaporizing a volatile component in a solution dot pattern after the droplet is jetted on the substrate so that a solid content is remained on the substrate, wherein the solution having micro-particle dispersed in liquid satisfies a relationship of 0.0002≦Dp/Do≦0.01 where Dp denotes a diameter of the metal micro-particle and Do denotes a diameter of the discharge opening.

In another exemplary embodiment of this disclosure, there is provided a solution including metal micro-particle material used for an electron-emitting device manufacturing apparatus that manufactures a surface conduction electron-emitting element by a conductive thin film, and the electron-emitting device manufacturing apparatus having a discharge head of a thermal-jet type using a heating element, the discharge head having discharge opening, the diameter of which is equal to or less than ϕ25 μm, and jetting a solution including the metal micro-particle material for forming the conductive thin film, and the discharge head jetting the solution on the area between the electrodes, which are formed on a substrate of the electron-emitting device, at a speed between 6 m/s and 18 m/s and vaporizing a volatile component in a solution dot pattern after the droplet is jetted on the substrate so that a solid content is remained on the substrate, wherein the solution having micro-particle dispersed in liquid satisfies a relationship of 0.0002≦Dp/Do≦0.01 where Dp denotes a diameter of the metal micro-particle and Do denotes a diameter of the discharge opening.

In another exemplary embodiment of this disclosure, there is provided an electron-emitting device including: a substrate; and a surface conduction electron-emitting element formed on the substrate by a conductive thin film, the conductive thin film is formed by jetting solution including a metal micro-particle material on the area between the electrodes, which are formed on a substrate of the electron-emitting device, and vaporizing a volatile component in a solution dot pattern after the droplet of solution is jetted on the substrate so that a solid content is remained on the substrate, wherein a diameter of the metal micro-particle in the solution is equal to or less than a roughness of a surface of the substrate where a dot pattern is formed, and a thickness of the dot pattern is greater than the roughness of the surface of the substrate.

In another exemplary embodiment of this disclosure, there is provided an image displaying apparatus, including: an electron-emitting device that includes: a substrate; and a surface conduction electron-emitting element formed on the substrate by a conductive thin film, the conductive thin film is formed by jetting solution including a metal micro-particle material on the area between the electrodes, which are formed on the substrate of the electron-emitting device, and vaporizing a volatile component in solution dot pattern after the droplet of solution is jetted on the substrate so that a solid content is remained on the substrate, and a diameter of the metal micro-particle in the solution is equal to or less than a roughness of a surface of the substrate where a dot pattern is formed, and a thickness of the dot pattern is greater than the roughness of the surface of the substrate; and a face plate arranged to be facing the electron-emitting device, and the face plate mounting fluorescent material and having a shape and size substantially the same with that of the electron-emitting device substrate.

BRIEF DESCRIPTION OF THE DRAWINGS

In the following, embodiments of the present invention will be described with reference to the accompanying drawings.

DESCRIPTION OF THE PREFERRED EMBODIMENT

In the following, an embodiment of the present invention will be described with reference to the accompanying drawings.

Figure 1:
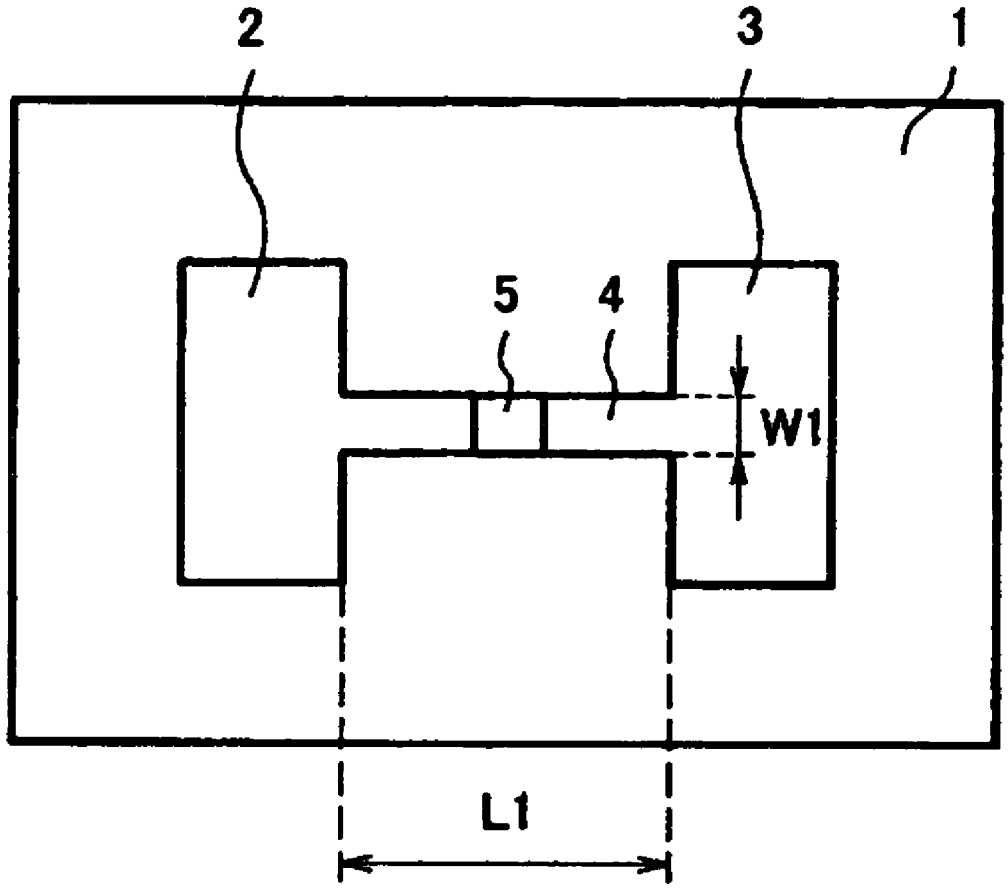
FIG. 1 is a diagram showing a conventional electron emitting device.
Figure 2A:
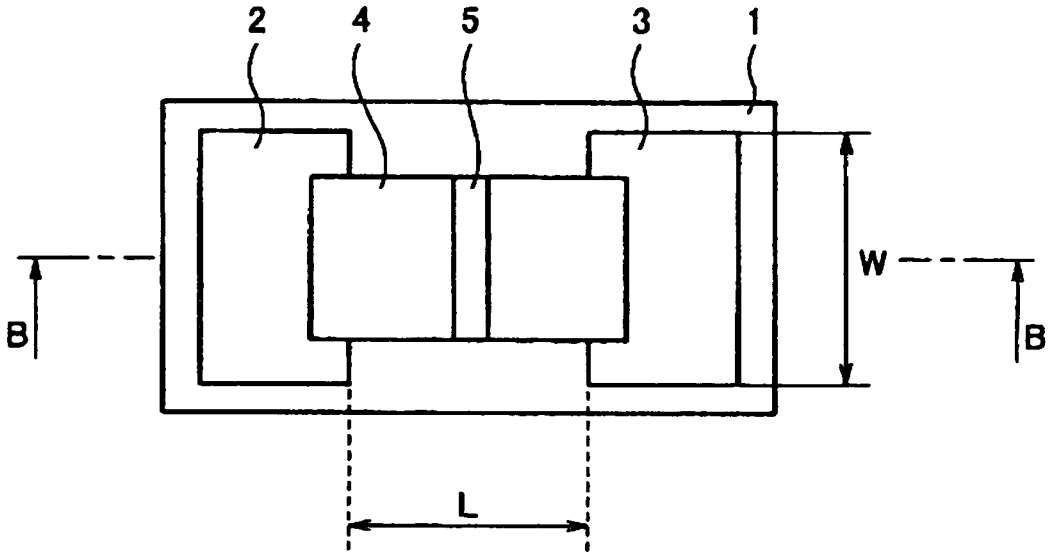
FIG. 2A is a plan view showing an example of an electron-emitting device according to an embodiment of the present invention.
Figure 2B:
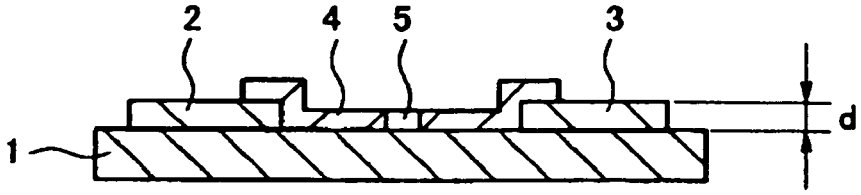
FIG. 2B is a sectional view taken substantially along lines B-B of FIG. 2A.

An example of an electron-emitting device configuring a surface conduction electron-emitting element will be described in reference with FIG. 2A and FIG. 2B according to an embodiment the present invention. FIG. 2A is a plan view showing the example of the electron-emitting device according to the embodiment the present invention, and FIG. 2B is a sectional view taken substantially along lines B-B of FIG. 2A. In FIG. 2A and FIG. 2B, an electron-emitting device 1 includes electrodes 2 and 3, a conductive thin film 4, and an electron emitting part 5. A basic configuration of surface conduction electron-emitting element according to the present invention is a tabular type. In FIG. 2A and FIG. 2B, a configuration of one tabular surface conduction electron-emitting element is illustrated. As described later, the tabular surface conduction electron-emitting element is actually configured as a element group arranged in a matrix.

As the substrate 1, a glass substrate where a quartz glass, a glass where an impurity content such as Na or a like is reduced, a blue plate glass, or $SiO_2$ is accumulated can be used. Also, a ceramic substrate such as an alumina can be used as the substrate 1. As a material of electrodes 2 and 3, a regular conductive material can be used. For example, the material can be selected from a metal or an alloy of Ni, Cr, Au, Mo, W, Pt, Ti, Al, Cu, Pd, or a like, a print conductor configured of a metal or a metal oxide of Pd, As, Ag, Au, $RuO_2$, Pd—Ag, or a like and a glass, a transparent electric conductor of $In_2O_3$—$SnO_2$ or a like, or a semiconducting material of polysilicon or a like.

A length L between the electrodes 2 and 3 may be in a range from a few thousand Å to a few hundred μm. Alternatively, considering a voltage or a like applied between the electrodes 2 and 3, the length may be in a range from 1 μm to 100 μm. Considering a resistance value and an electron emission characteristic of the electrodes 2 and 3, a width W of the electrodes 2 and 3 is in a range from a few μm to a few hundred μm and a thickness d of the electrodes 2 and 3 is in a range from 100 Å to 1 μm.

Figure 3A:
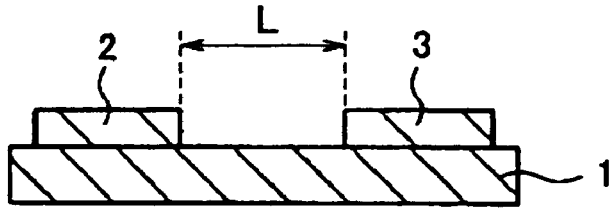
FIG. 3A is a diagram showing a method for manufacturing a surface conduction electron-emitting element.
Figure 3B:
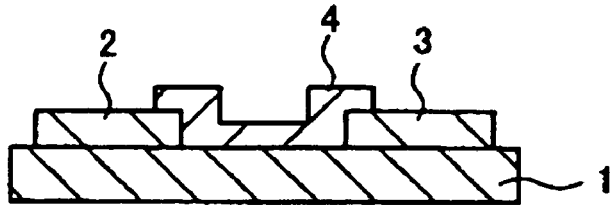
Figure 3C:
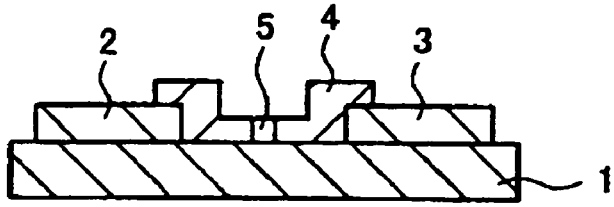

A tabular surface conduction electron-emitting device manufacturing method will be described with reference to FIG. 3A, FIG. 3B, and FIG. 3C. FIG. 3A is a diagram showing a state of forming the electrodes 2 and 3 on the substrate 1, FIG. 3B is a diagram showing a state of forming the conductive thin film 4 on the electrodes 2 and 3, and FIG. 3C is a diagram showing a state of forming the electron emitting part 5 in the conductive thin film 4. As the conductive thin film 4, in order to obtain a preferable electron emission characteristic, a micro-particle film configured of micro-particles may be used. The thickness of the conductive thin film 4 is selectively set based on a step-coverage to the electrodes 2 and 3, a resistance value between the electrodes 2 and 3, an electric forming condition that will be described later, and a like. The thickness may be in a range from a few Å to a few thousand Å. Preferably, the thickness is in a range from 10 Å to 500 Å. Moreover, the resistance value Rs of the micro-particle film may be the second power of 10 or the seventh power of 10Ω. The resistance value Rs is obtained by a formula R=Rs (1/w) where t denotes the thickness of the electrodes 2 and 3, w denotes the width of the electrodes 2 and 3, and the resistance R of the thin film at the length "1". Also, the resistance value Rs is expressed by Rs=ρ/t where ρ denotes a resistivity of the thin film material. In the embodiment, the electric process is illustrated as a forming process. However, the forming process is not limited to the electric process. Any method for forming a high resistance state by causing a crack to the film can be applied.

As the surface conduction electron-emitting element according to the present invention, a metal such as Pd, Pt, Ru, Ag, Zn, Sn, W, Pb, or a like can be used to be a material to configure the conductive thin film 4 and can be a material to conduct a preferable electron emission. However, as described later, a compatibility of a droplet jet head used in the electron-emitting device manufacturing apparatus should be concerned. Not all possible materials described above are suitable materials.

The micro-particle film described in the embodiment represents a film as a set of a plurality of micro-particles. A microscopic configuration can show not only a state of a dispersion arrangement in that micro-particles are dispersed but also a state in that the micro-particles are adjacent each other or a state in that the micro-particles are overlapped each other including a state in that some particles form a set like an island as a whole. A particle diameter of each micro-particle is in a range from a few Å to 1 μm. A suitable particle diameter may be in a range from 10 Å to 200 μm.

It should be noted that the present invention is not limited to the configuration shown in FIG. 2A and FIG. 2B. Alternatively, the electrodes 2 and 3 may be formed on the conductive thin film 4 on the substrate 1.

Figure 4:
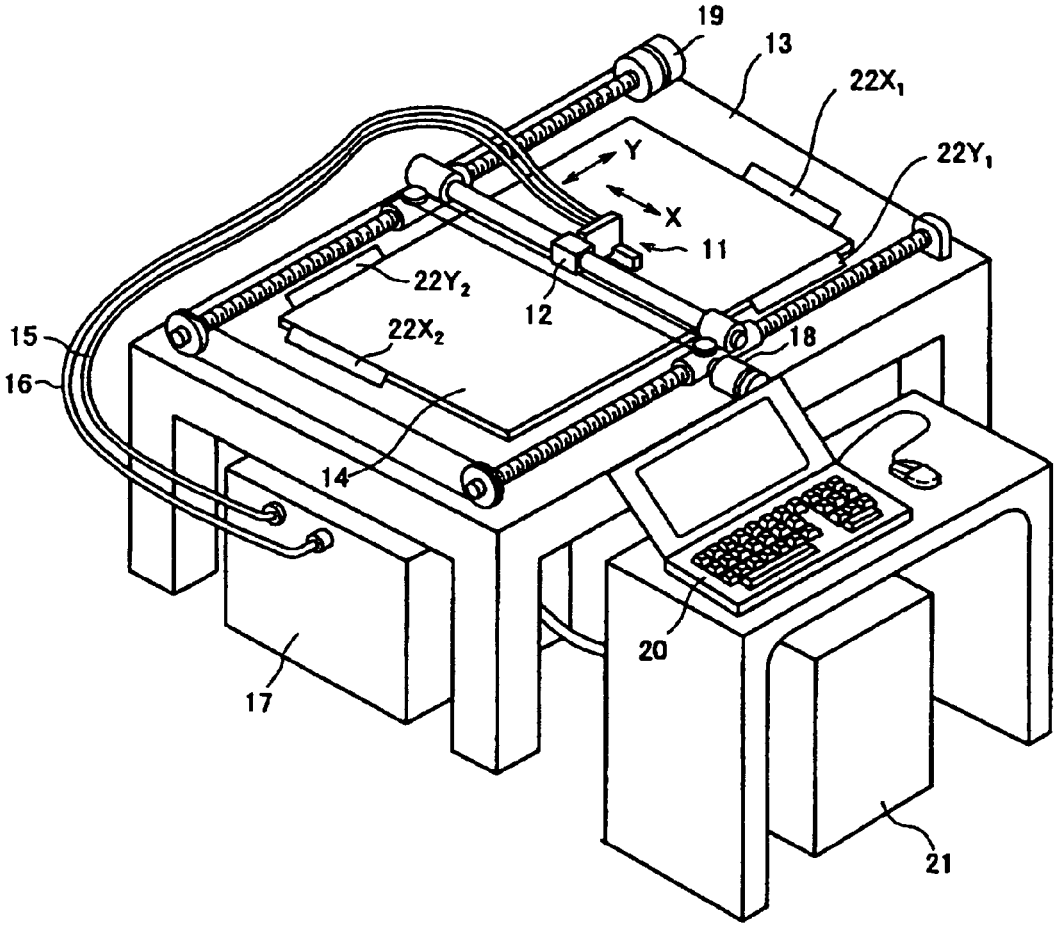
FIG. 4 is a diagram illustrating an electron-emitting device manufacturing apparatus.

Next, the electron-emitting device manufacturing apparatus in that the surface conduction electron-emitting element according to the embodiment of the present invention will be described. FIG. 4 is a diagram illustrating the electron-emitting device manufacturing apparatus. In FIG. 4, the surface conduction electron-emitting element includes a discharge head unit 11 (jet head), a carriage 12, a substrate supporting table 13, a substrate 14 forming the tabular surface conduction electron-emitting element group, a supplying tube 15 for supplying a solution including a material of the conductive thin film, a signal supplying cable 16, a discharge head control box 17, an x-direction scan motor 18 of the carriage 12, a y-direction scan motor of the carriage 12, a computer 20, a control box 21, and substrate positioning/supporting parts $22X_1$, $22Y_1$, $22X_2$, and $22Y_2$.

In a configuration shown in FIG. 4, the discharge head unit 11 moves along a front surface of the substrate 14 supported on the substrate supporting table 13 by a carriage scanning movement and the solution including the conductive thin film material is jetted. Any configuration can be applied in that a given droplet can be jetted by a determinate quantity. The given droplet may be approximate from a few ten picoliter to a few picoliter. Alternatively, a mechanism of an ink-jet method capable of forming a minute amount of a droplet is desired to form may be desired. As the ink-jet method, a piezo-jet method using a piezoelectric element, a bubble jet™ that generating bubbles by utilizing a thermal energy of a heater, a charge control method (continuous current method), or a like can be applied.

Figure 5:
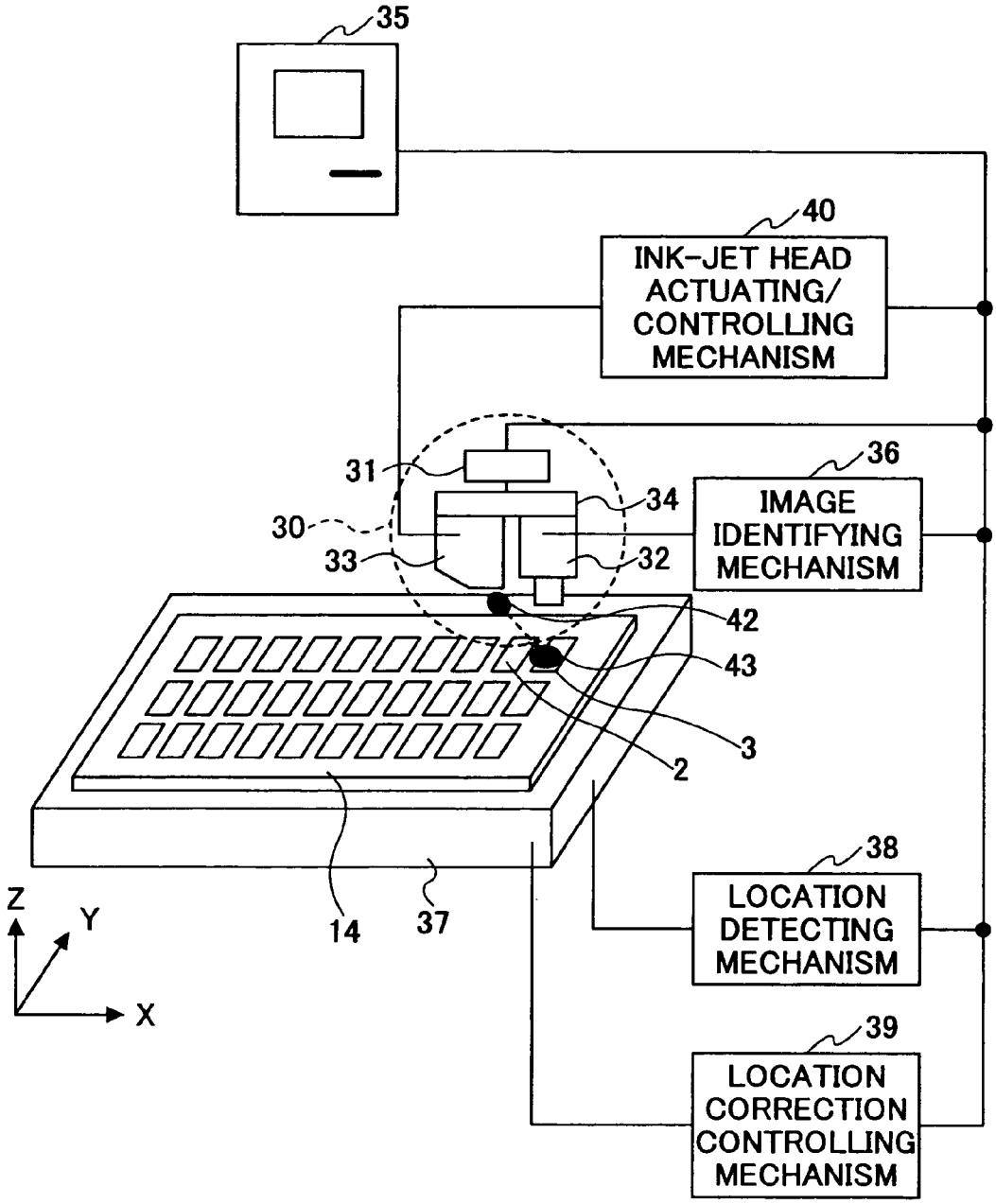
FIG. 5 is a diagram for explaining a configuration of a droplet providing apparatus.
Figure 6A:
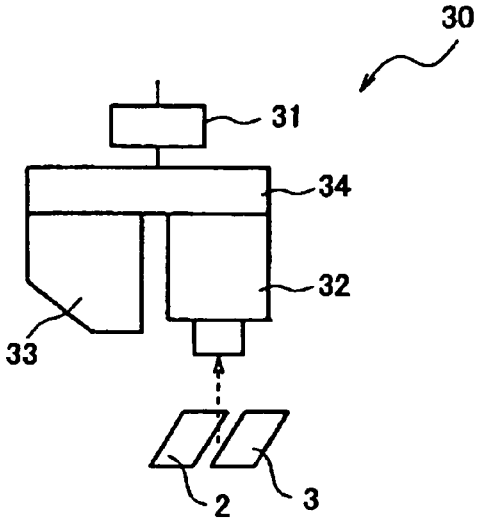
FIG. 6A and FIG. 6B are schematic diagrams showing a main part of a discharge head unit of the droplet providing device shown in FIG. 5.
Figure 6B:
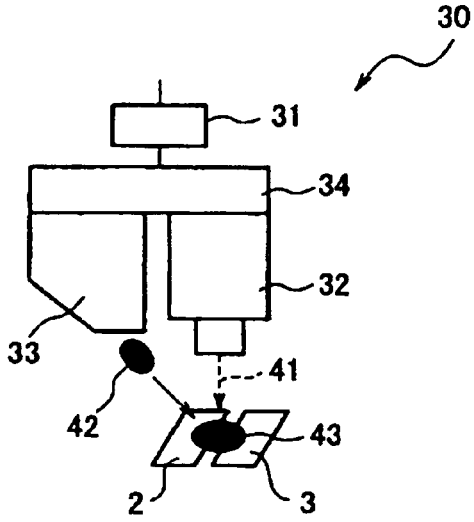

FIG. 5 is a schematic diagram for explaining a configuration of a droplet providing device where the electron-emitting device manufacturing method according to the present invention can be applied. FIG. 6A and FIG. 6B are schematic diagrams showing a main part of the discharge head unit of a droplet providing device shown in FIG. 5. The configuration shown in FIG. 5 is different from the configuration shown in FIG. 4 in that the electron emitting device group is formed by moving the substrate. In FIG. 5, FIG. 6A, and FIG. 6B, the droplet providing device includes electrodes 2 and 3, a substrate 14, a discharge head unit 30 (corresponding to a discharge head unit 11 in FIG. 4), a head alignment controlling mechanism 31, a detection optical system 32 for focusing a dropped location 43 by an optical axis 41, a ink-jet head 33 for jetting a droplet 42, a head alignment fine activating mechanism 34, a control computer 35, an image identifying mechanism 36, an xy-directions scanning mechanism 37, a location detecting mechanism 38, a location correction controlling mechanism 39, and an ink-jet head actuating/controlling mechanism 40.

Similar to the configuration shown in FIG. 4, the droplet providing device (ink-jet head 33) of the discharge head unit 30 is desired to be a mechanism of the ink-jet method. The piezo-jet method using the piezoelectric element, the bubble jet™ that generating bubbles by utilizing a thermal energy of a heater, a charge control method (continuous current method), or a like can be applied.

Next, a configuration of an apparatus that moves the substrate 14 will be described with reference to FIG. 5. First, in FIG. 5, the substrate 14 is mounted on the xy-direction scanning mechanism 37. The surface conduction electron-emitting element on the substrate 14 has the same configuration as the surface conduction electron-emitting element shown in FIG. 2A and FIG. 2B. Similar to the surface conduction electron-emitting element in FIG. 2A and FIG. 2B, a single surface conduction electron-emitting element includes a substrate 1, a electrodes 2 and 3, and a conductive thin film (micro-particle film) 4. The discharge head unit 30 for providing a droplet is positioned above the substrate 14. In the embodiment, the discharge head unit 30 is fixed and the substrate 14 is moved in x and y directions toward a given location, so that a relative displacement between the discharge head unit 30 and the substrate 14 can be realized.

Next, the configuration of the discharge head unit 30 will be described with reference to FIG. 6A and FIG. 6B. The detection optical system 32 is used to read image information on the substrate 14 and is adjacent to the ink-jet head 33 for jetting a droplet 42. The detection optical system 32 is arranged so as to correspond the optical axis 41 and a focus location of the detection optical system 32 to the dropped location 43 of the droplet 42 of the ink-jet head 33. In this case, a physical relationship between the detection optical system 32 and the ink-jet head 33 is precisely adjusted by the head alignment fine activating mechanism 34 and the head alignment controlling mechanism 31. In addition, the detection optical system 32 includes a CCD (Charge Coupled Device) camera and a lens.

Referring to FIG. 5 again, the image identifying mechanism 36 is used to identify the image information read by the detection optical system 32. The image identifying mechanism 36 includes a function for digitalizing a contrast of an image and calculating a location of a center of gravity for a specified contrast part being digitalized. In detail, a high precise image recognition apparatus (VX-4210) provided by Keyence Corporation can be used. The location detecting mechanism 38 provides location information on the substrate 14 to the image information obtained by the high precise image recognition apparatus. For the location detection mechanism, an end-measuring machine such as a linear encoder or a like provided in the xy-directions scanning mechanism 37 can be utilized. In addition, the location correction controlling mechanism 39 conducts a location correction based on the location information on the substrate 14 and the image information, and applies a correction to a movement of the xy-directions scanning mechanism 37. Moreover, the ink-jet head 33 is actuated by the ink-jet head actuating/controlling mechanism 40 and the droplet is applied on the substrate 14. Each control mechanism described above is intensively controlled by the control computer 35.

In the embodiment, the discharge head unit 30 is fixed and the substrate 14 is moved in x and y directions toward a given location, so that a relative displacement between the discharge head unit 30 and the substrate 14 can be realized. Alternatively, as shown in FIG. 4, the substrate 14 is fixed, and the discharge head unit 30 is controlled to scan in the x and y directions. In detail, in a case of applying to an image forming apparatus having a medium screen size approximate 200 mm×200 mm from a large screen size approximate 2000 mm×2000 mm or a larger screen size, such as a latter configuration, the substrate 14 may be fixed, the discharge head unit 30 may scan in the orthogonal x and y directions, and then the droplet of the solution may be provided in the x and y directions in sequence.

As another example, in a case in that a length of a substitute size in a latitudinal direction is equal to or less than about 400 mm, a large array multi nozzles type capable of covering in a range of 400 mm can be applied to the discharge head unit 30 for providing a droplet. Accordingly, without conducting the relative displacement in orthogonal two directions (x direction and y direction), it is possible to conduct the relative displacement in one direction (a longitudinal direction) alone (for example, only x direction) and it is possible to realize higher productivity. However, in a case in that the latitudinal direction of the substitute size is longer than 400 mm, it is difficult to produce the discharge head unit 30 of the large array multi nozzles type technically and a higher expense is required. Therefore, as shown in the embodiment of the present invention, the configuration in that the discharge head unit 30 scans in the orthogonal x and y directions and the droplet of the solution is provided in the orthogonal x and y direction in sequence.

As a material of the droplet 42, a water solution including an element or a chemical compound to be the conductive thin film above-described can be applied. For example, the element or the chemical compound to be the conductive thin film can be palladic as follows: a water solution including Ehanolamine complex such as Palladium acetate-Ethanolamine complex (PA-ME), Palladium acetate-Ethanolamine complex (PA-ME), Palladium acetate-Diethanolamine complex (PA-DE), Palladium acetate-Triethanolamine complex (PA-TE), Palladium acetate-Butylethanolamine complex (PA-BE), Palladium acetate-Dimethylethanolamine complex (PA-DME), or a like. Moreover, the element or the chemical compound to be the conductive thin film can be as follows: a water solution including amino acids complex such as Palladium acetate Glycine complex (Pd-Gly), Palladium acetate-β-Alanine complex (Pd-β-Ala), Palladium acetate-DL-Alamine complex (Pd-DL-Ala), or a like. Furthermore, the element or the chemical compound to be the conductive thin film can be such as a Butyl acetate solution of Palladium acetate Bis Dipropylamine complex.

As one example, the Palladium acetate triethanolamine water solution will be described in detail. The Palladium acetate Triethanolamine water solution is produced as follows. A suspension is made by adding 50 g Palladium acetate to 500 cc isopropyl alcohol and 100 g Triethanolamine is added to the suspension sat 35° C. and has been stirred for 12 hours. After a reaction is ended, the isopropyl alcohol is eliminated by vaporizing the suspension, a solid material as a result of vaporization is dissolved by adding ethanol, and filtered. The Palladium acetate-Triethanolamine is crystallized again from a filtrate. By dissolving 10 g the Palladium acetate-Triethanolamine obtained as described above into 190 g purified water, a solution can become a jet solution.

As another example, the Palladium micro-particles are ozonized by ozone-producing apparatus producing 60V voltage, 50 Hz frequency, and 40 ml/min oxygen flow. 7 g ozonized Palladium micro-particles are dispersed into a solution of 5 g ethylene glycol, 8 g Ethanol, 80 g Purified water to produce the jet solution.

As clearly described above, the electron-emitting device according to the present invention is produced by jetting the solution including the element or the chemical compound to be the conductive thin film in accordance with a jet-ink principle and providing the droplet on a substrate. However, in order to stably form the surface conduction electron-emitting element at a high grade for a long term, the electron-emitting device producing apparatus should stably maintain a certain performance. The most important point is a long term performance stability of a discharge head. As described above, according to the present invention, the solution including the material to form the conductive then film is a solution where the metal micro-particles are dispersed in liquid.

However, the metal micro-particles are such as abrasive grains dispersed in the solution. In a case of using a large amount of this solution, a path the discharge head for the solution is damaged and worn. In the path, especially, a scratch around a discharge opening part (nozzle part) and abrasion influence a droplet jet performance of the solution.

The scratch and abrasion are caused when two materials collide or scratched each other. Accordingly, these problems can be eliminated by properly selecting hardness of two materials. Moreover, it is true that the scratch influences the droplet jet performance. It is thought that this influence depends on a size of the scratch and a size of the path. For example, even if there is a scratch of a nanometer order in a hose having Φ15 mm-Φ20 m inside diameter for jetting the droplet, this scratch cannot greatly influence a discharging flow.

In the embodiment of the present invention, hardness of the material of the discharge opening part, hardness of the material of the metal micro-particles, and the size of the discharge opening part were carefully considered.

Figure 7A:
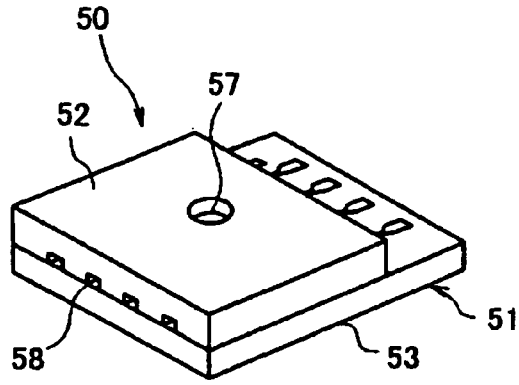
FIG. 7A, FIG. 7B, and FIG. 7C are diagrams showing the discharge head used by the apparatus for manufacturing a tabular surface conduction electron-emitting element according to the embodiment of the present invention.
Figure 7B:
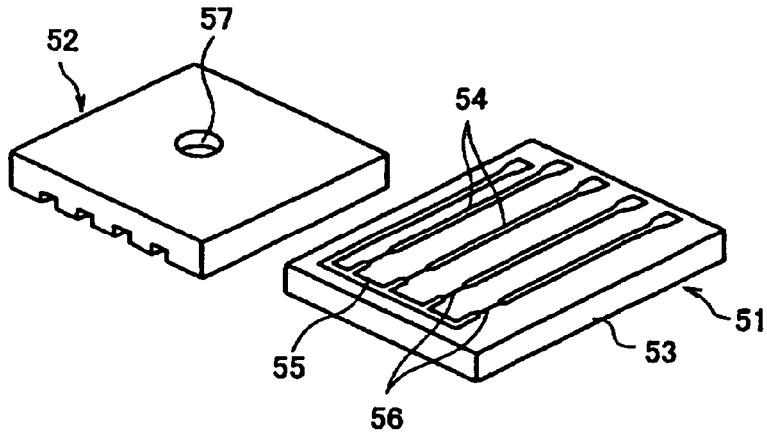
Figure 7C:
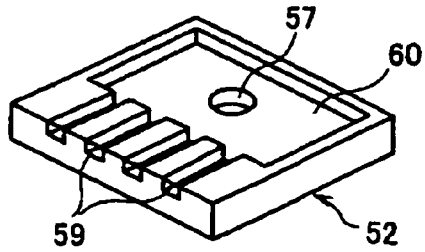

In detail, by using the discharge head as shown FIG. 7A, FIG. 7B, and FIG. 7C, which was a discharge head where a multi nozzle plate wad attached on a surface of a rectangular nozzle part 58, the solution had been jetted fro a certain period, and then it was checked whether or not a scratch was caused at the discharge opening part (nozzle hole) and it was checked whether or not a formed device shape (shape quality of a dot pattern) and a device performance was influenced by deterioration of a performance of discharging a droplet of the solution. Various materials and various nozzle diameters (a round shape was applied in this case) were prepared as the multi nozzle plate. The device performance was checked after a forming process and a like were conducted as described later.

The discharge head used in this examination was a thermal ink-jet type using thermal energy and the nozzle plate was mounted to the discharge head (the nozzle plate is not shown in FIGS. 7A, 7B, and 7C) as described above. In FIG. 7A through FIG. 7C, for the sake of convenience, only four discharge openings are shown. In the experiment, the discharge head having 64 discharge openings was actually used and an arrangement density of these discharge openings was 400 dpi. In FIG. 7A through FIG. 7C, a discharge head 50 includes a heating element substrate 51, a silicon substrate 53, electrodes 54, a common electrode 55, a heating element 56, a solution inflow opening 57, a nozzle 58, a groove portions 59, and a depressed portion 60. FIG. 7A is a perspective view of the discharge head, FIG. 7B is an exploded view of the heating element substrate and the cover substrate, and FIG. 7C is a perspective view of the cover substrate from a backside.

In addition, a size of the heating element was 22 μm×90 μm, a resistance value was 111Ω, a drive voltage of a droplet jet was 24V, a drive pulse width was 6.5 μs, and a drive frequency was 12 kHz.

A 100 hours successive jet had been conducted. An SEM observation was conducted with respect to the discharge opening part after the 100 hours successive jet was ended. Then, it was checked whether or not a scratch is caused.

Φ25 μm, Φ16 μm, and Φ10 μm nozzle diameters were prepared for a discharge head H1, a discharge head H2, and a discharge head H3, respectively. A Φ36 μm nozzle diameter was prepared to be compared for a reference head. In this case, the discharge head included 48 discharge openings and the arrangement density was 240 dpi. And the size of the heating element was 35 μm×150 μm, the resistance value was 120Ω, the drive voltage of the ink jet was 30V, the drive pulse width was 7 μs, and the drive frequency was 3.8 kHz. The thickness of the nozzle plate of the discharge heads H1 and H2 were 30 μm, the thickness of the nozzle plate of discharge head H3 was 20 μm, and the reference head was 40 μm. Droplet speeds of the discharge heads H1, H2, and H3 were approximately 8 m/s.

A nozzle plate material was Ni and austenitic stainless SUS304. The multi nozzle plate was produced from a Ni material by an electro-forming method. The multi nozzle plate was produced from an SUS304 material by trephining nozzle openings by conducting an electrondischarge method with respect to a stainless plate. Each hardness degree was measured by a Vickers sclerometer. In a case of the Ni material, the Vickers sclerometer Hv was 58 through 63. In a case of the SUS304 material, the Vickers sclerometer Hv was 170 through 190.

Liquid used in this experiment is shown as S1 through S7 in a table 1. In the table 1, an element name of an included metal particle and the Vickers hardness degree Hv in a bulk state. As the Vickers hardness degree, values shown in a metal data book (Nippon Kinzoku Gakkai, version No. 3, Maruzen) are shown in the table 1. A metal particle content in each solution was 7%, and a particle diameter was from 150 Å to 200 Å.

TABLE 1

| Sample Number | Included Metal Particle | Vickers Hardness Degree Hv |
|---|---|---|
| S1 | Pd | 38 |
| S2 | Pt | 39 |
| S3 | Ru | 350 |
| S4 | Ag | 26 |
| S5 | Zn | 45 |
| S6 | W | 360 |
| S7 | Pb | 37 |

Evaluation results of using these sample solutions and discharge heads H1, H2, H3, and the reference head will be shown in table 2 through table 5. In the table 2 through table 5, "o" of a scratch item indicates that no obvious scratch was found after the 100 hours successive jet and "x" of the scratch item indicates that a plurality of scratches that influence the nozzle shape or the nozzle size were found after the 100 hours successive jet. "o" of a device shape indicates that the dot pattern was formed at a proper round shape at a target location (between a pair of electrodes) when the device is produced after the 100 hours successive jet and "x" of the device shape indicates that the dot pattern was not form at the proper round shape, the dot pattern was not formed at the target location (that is, the dot pattern was formed at a location slightly displacing from the target location), or minute drops were scattered around the target location after the 100 hours successive jet. "o" and "x" of a device performance indicate "o (good)" and "x (bad)" of an electron emission after the forming process described later was conducted.

TABLE 2 case of Φ25 μm nozzle diameter

| | Discharge Opening Material Ni | | | Discharge Opening Material SUS304 | | |
|---|---|---|---|---|---|---|
| | Scratch | Device Shape | Device Performance | Scratch | Device Shape | Device Performance |
| S1 | o | o | o | o | o | o |
| S2 | o | o | o | o | o | o |
| S3 | x | x | x | x | x | x |
| S4 | o | o | o | o | o | o |
| S5 | o | o | o | o | o | o |
| S6 | x | x | x | x | x | x |
| S7 | o | o | o | o | o | o |

TABLE 3 case of Φ16 μm nozzle diameter

| | Discharge Opening Material Ni | | | Discharge Opening Material SUS304 | | |
|---|---|---|---|---|---|---|
| | Scratch | Device Shape | Device Performance | Scratch | Device Shape | Device Performance |
| S1 | o | o | o | o | o | o |
| S2 | o | o | o | o | o | o |
| S3 | x | x | x | x | x | x |
| S4 | o | o | o | o | o | o |
| S5 | o | o | o | o | o | o |
| S6 | x | x | x | x | x | x |
| S7 | o | o | o | o | o | o |

TABLE 4 case of Φ10 μm nozzle diameter

| | Discharge Opening Material Ni | | | Discharge Opening Material SUS304 | | |
|---|---|---|---|---|---|---|
| | Scratch | Device Shape | Device Performance | Scratch | Device Shape | Device Performance |
| S1 | o | o | o | o | o | o |
| S2 | o | o | o | o | o | o |
| S3 | x | x | x | x | x | x |
| S4 | o | o | o | o | o | o |
| S5 | o | o | o | o | o | o |
| S6 | x | x | x | x | x | x |
| S7 | o | o | o | o | o | o |

TABLE 5 case of Φ36 μm nozzle diameter (reference head)

| | Discharge Opening Material Ni | | | Discharge Opening Material SUS304 | | |
|---|---|---|---|---|---|---|
| | Scratch | Device Shape | Device Performance | Scratch | Device Shape | Device Performance |
| S1 | o | o | o | o | o | o |
| S2 | o | o | o | o | o | o |
| S3 | x | o | o | x | o | o |
| S4 | o | o | o | o | o | o |
| S5 | o | o | o | o | o | o |
| S6 | x | o | o | x | o | o |
| S7 | o | o | o | o | o | o |

Referring to the evaluation results, in a case that the hardness degree of the included metal micoparticle is greater than the hardness degree of the discharge opening material (S3 and S6), it can be known that the discharge opening is damaged. Accordingly, the device shape formed by the included metal micoparticles is deteriorated and the device performance is deteriorated. therefore, when the surface conduction electron-emitting element is formed by the manufacturing apparatus according to the present invention, it is required to select a material softer than the discharge opening, as the metal micro-particle.

As for the scratch, due to a relationship with the size of the discharge opening, there are discharge heads which device shapes were not deteriorated. Such as the reference head, in a case in that the nozzle diameter is Φ36 μm at least (=approximate 1000 $\mu m^2$ area), even if the discharge opening is scratched, the nozzle diameter is large enough not to deteriorate the jet performance. Thus, a practical device shape can be sufficiently obtained. On the other hand, in a case that the nozzle diameter is equal to or less than Φ25 μm (=less than approximate 500 $\mu m^2$ area), that is, in a case in that the nozzle diameter is equal to or less than half the nozzle diameter of the reference head in an area comparison, even if the similar scratch is caused, that influence becomes greater in a comparison of the nozzle diameter. Accordingly, the device shape and the device performance cannot be properly obtained.

That is, if it is not needed to form such the minute surface conduction electron-emitting element, a problem of the scratch does not influence to the device performance so that the scratch can be ignored. However, in a case in that a solution including a metal micro-particle having 10 Å through 200 Å is jetted by a drop let jet head having a nozzle diameter equal to or less than Φ25 μm and the surface conduction electron-emitting element group is formed with the conductive thin film, a scratch of the discharge opening part can be pernicious. Thus, it is required to select a combination of a solution and a discharge opening member in order to prevent the scratch. That is, it is required to select the metal micro-particle softer than members configuring the discharge opening.

In the examination, the discharge openings being round and having the Φ25 μm nozzle diameter (approximate 490 $\mu m^2$ area), the Φ16 μm nozzle diameter (approximate 200 $\mu m^2$ area), and the Φ10 μm nozzle diameter (approximate 80 $\mu m^2$ area) are used. Alternatively, in a case in which another shape (for example, a rectangle) is used as the nozzle of the discharge head, an area of another shape is compared. For example, since a 22 μm×22 μm area of another shape is similar to a Φ25 μm area of the nozzle being round according to the present invention, such the shape may be applied. In other words, the present invention is applied to a case in that the discharge head using the nozzle having an area smaller than 500 $\mu m^2$ and the surface conduction electron-emitting element group is formed by jetting the solution described above.

Next, another feature of the present invention will be described. As described above, in the present invention, the solution including a material forming the conductive thin film is a solution dispersing metal micro-particles in liquid. And the solution is jetted from a minute discharge opening by a technology similar to the ink-jet principle. The technology is related to a technology forming the conductive thin film on a substrate. An ink used in a conventional ink-jet recording field dissolves dye in the solution. Compared with the ink used in the convention ink-jet recording medium, in the solution used in the present invention, the metal micro-particles are simply dispersed in the solution. As a result, a clogging problem is easily caused.

Furthermore, in the present invention, in a viewpoint of usage of a device (electron emitting device) that is needed, the discharge head having a nozzle diameter that had not existed conventionally, for example, a nozzle diameter equal to or less than Φ25 μm (smaller than a 500 $\mu m^2$ area) is required to use. Thus, this clogging problem becomes serious.

The clogging is originated from a principle in that the solution is jetted from the minute discharge opening. That is, this is a reason why the discharge opening is minute. Accordingly, the size of the discharge opening has a close relationship with the size to the metal micro-particle that can be a foreign object in the solution.

In the present invention, considering this point, the size of the discharge opening and the size of the metal micro-particle is focused on and a relationship between a difficulty of causing the clogging and the sizes of the discharge opening and the metal micro-particle is found out. In detail, solutions including the metal micro-particle having a different metal micro-particle diameter were concocted. The discharge head, in that the size of the discharge opening was known, was used. After the successive droplet jet for a certain time, the discharge head had been left for a certain time, the droplet jet was conducted again, and then it was checked whether or not the discharge opening is clogged. In this case, this examination was made in that not only a complete clogging of the discharge opening but also a partial clogging of the discharge opening were recognized as the clogging.

The discharge heads used in this examination is similar discharge heads using a thermal energy. As described above, the discharge heads used in this examination was the discharge head shown in FIG. 7A through FIG. 7C to which the nozzle plate (not shown in FIG. 7A through FIG. 7C) was mounted. In FIG. 7A through FIG. 7C, for the sake of convenience, only four discharge openings are shown. In the experiment, the discharge head having 128 discharge openings was actually used and an arrangement density of these discharge openings was 600 dpi. In addition, a size of the heating element was 20 μm×85 μm, a resistance value was 105Ω, a drive voltage of a droplet jet was 22V, a drive pulse width was 6 μs, and a drive frequency was 14 kHz. Discharge heads H1 through H4 were prepared (nozzle diameters of the discharge heads H1 through H4 were Φ25 μm, Φ20 μm, Φ15 μm, and 10 μm, respectively). In addition, the nozzle plate was a nozzle plate formed by the electro-forming method for the Ni material. And a board thickness of the discharge opening was 30 μm.

The solution used in this examination was made as a jet solution by ozonizing the palladium micro-particles at the ozone-producing apparatus of 60V voltage, 50 Hz frequency, and 40 ml/min oxygen flow and dispersing 7 g palladium micro-particles that were ozonized in a solution of 5 g ethylene glycol, 8 g Ethanol, and 80 g purified water. The palladium micro-particles, which diameters were varied to be from 0.0003 μm to 0.5 μm, were prepared and were combined with the discharge heads H1 through H4 having a different nozzle diameter. Then, the examination was conducted. In addition, a condition of leaving the discharge heads H1 through H4 for a certain time (10 min) after the droplet jet was conducted was to leave in an atmosphere of 40° C. and 30% moisture for 10 min.

By combining the solutions including the palladium particles having a different diameter and different discharge head H1 through H4, results of occurrences of the clogging are shown in tables 6 through 9.

The table 6 shows a case of using the discharge head H1 (nozzle diameter Do=Φ25 μm). The table 7 shows a case of using the discharge head H2 (nozzle diameter Do=Φ20 μm). The table 8 shows a case of using the discharge head H3 (nozzle diameter Do=Φ15 μm). The table 8 shows a case of using the discharge head H4 (nozzle diameter Do=Φ10 μm). A determination "o" indicates that the discharge head can be used practically and properly, a determination "Δ" indicates that the discharge head can be used but not be proper, and a determination "x" indicates that the discharge head cannot be used practically. In a case that the diameter of the palladium particle was equal to or less than 0.001 μm, the palladium particles were not stably dispersed. Thus, that case could not be evaluated.

TABLE 6 case of the discharge head H1 (nozzle diameter Do = Φ25 μm)

| Solution | Diameter of Palladium Micro-particle Dp (μm) | Dp/Do | Clogging State Clogged Discharge Openings/Total Discharge Openings | Determination |
|---|---|---|---|---|
| 1 | 0.0003 | 0.000012 | Not evaluated since not possible to produce stable solution | — |
| 2 | 0.0005 | 0.00002 | Not evaluated since not possible to produce stable solution | — |
| 3 | 0.001 | 0.00004 | Not evaluated since not possible to produce stable solution | — |
| 4 | 0.002 | 0.00008 | 0/128 | ○ |
| 5 | 0.004 | 0.00016 | 0/128 | ○ |
| 6 | 0.006 | 0.00024 | 0/128 | ○ |
| 7 | 0.009 | 0.00036 | 0/128 | ○ |
| 8 | 0.02 | 0.0008 | 0/128 | ○ |
| 9 | 0.05 | 0.002 | 0/128 | ○ |
| 10 | 0.07 | 0.0028 | 0/128 | ○ |
| 11 | 0.1 | 0.004 | 0/128 | ○ |
| 12 | 0.15 | 0.006 | 0/128 | ○ |
| 13 | 0.2 | 0.008 | 0/128 | ○ |
| 14 | 0.25 | 0.01 | 0/128 | ○ |
| 15 | 0.3 | 0.012 | 13/128 (partially clogged) | Δ |
| 16 | 0.5 | 0.02 | 20/128 (completely clogged) | x |

TABLE 7 case of the discharge head H2 (nozzle diameter Do = Φ20 μm)

| Solution | Diameter of Palladium Micro-particle Dp (μm) | Dp/Do | Clogging State Clogged Discharge Openings/Total Discharge Openings | Determination |
|---|---|---|---|---|
| 1 | 0.0003 | 0.000015 | Not evaluated since not possible to produce stable solution | — |
| 2 | 0.0005 | 0.000025 | Not evaluated since not possible to produce stable solution | — |
| 3 | 0.001 | 0.00005 | Not evaluated since not possible to produce stable solution | — |
| 4 | 0.002 | 0.0001 | 0/128 | ○ |
| 5 | 0.004 | 0.0002 | 0/128 | ○ |
| 6 | 0.006 | 0.0003 | 0/128 | ○ |
| 7 | 0.009 | 0.00045 | 0/128 | ○ |
| 8 | 0.02 | 0.001 | 0/128 | ○ |
| 9 | 0.05 | 0.0025 | 0/128 | ○ |
| 10 | 0.07 | 0.0035 | 0/128 | ○ |
| 11 | 0.1 | 0.005 | 0/128 | ○ |
| 12 | 0.15 | 0.0075 | 0/128 | ○ |
| 13 | 0.2 | 0.01 | 0/128 | ○ |
| 14 | 0.25 | 0.0125 | 7/128 (partially clogged) | Δ |
| 15 | 0.3 | 0.015 | 41/128 (completely clogged) | x |
| 16 | 0.5 | 0.025 | 63/128 (completely clogged) | x |

TABLE 8 case of the discharge head H2 (nozzle diameter Do = Φ15 μm)

| Solution | Diameter of Palladium Micro-particle Dp (μm) | Dp/Do | Clogging State Clogged Discharge Openings/Total Discharge Openings | Determination |
|---|---|---|---|---|
| 1 | 0.0003 | 0.00002 | Not evaluated since not possible to produce stable solution | — |
| 2 | 0.0005 | 0.000033 | Not evaluated since not possible to produce stable solution | — |
| 3 | 0.001 | 0.000067 | Not evaluated since not possible to produce stable solution | — |
| 4 | 0.002 | 0.000133 | 0/128 | ○ |
| 5 | 0.004 | 0.000267 | 0/128 | ○ |
| 6 | 0.006 | 0.0004 | 0/128 | ○ |
| 7 | 0.009 | 0.0006 | 0/128 | ○ |
| 8 | 0.02 | 0.00133 | 0/128 | ○ |
| 9 | 0.05 | 0.00333 | 0/128 | ○ |
| 10 | 0.07 | 0.00467 | 0/128 | ○ |
| 11 | 0.1 | 0.00667 | 0/128 | ○ |
| 12 | 0.15 | 0.01 | 0/128 | ○ |
| 13 | 0.2 | 0.0133 | 5/128 (partially clogged) | Δ |
| 14 | 0.25 | 0.0167 | 7/128 (completely clogged) | x |
| 15 | 0.3 | 0.02 | 42/128 (completely clogged) | x |
| 16 | 0.5 | 0.0333 | 77/128 (completely clogged) | x |

TABLE 9 case of the discharge head H2 (nozzle diameter Do = Φ10 μm)

| Solution | Diameter of Palladium Micro-particle Dp (μm) | Dp/Do | Clogging State Clogged Discharge Openings/Total Discharge Openings | Determination |
|---|---|---|---|---|
| 1 | 0.0003 | 0.00003 | Not evaluated since not possible to produce stable solution | — |
| 2 | 0.0005 | 0.00005 | Not evaluated since not possible to produce stable solution | — |
| 3 | 0.001 | 0.0001 | Not evaluated since not possible to produce stable solution | — |
| 4 | 0.002 | 0.0002 | 0/128 | ○ |
| 5 | 0.004 | 0.0004 | 0/128 | ○ |
| 6 | 0.006 | 0.0006 | 0/128 | ○ |
| 7 | 0.009 | 0.0009 | 0/128 | ○ |
| 8 | 0.02 | 0.002 | 0/128 | ○ |
| 9 | 0.05 | 0.005 | 0/128 | ○ |
| 10 | 0.07 | 0.007 | 0/128 | ○ |
| 11 | 0.1 | 0.01 | 0/128 | ○ |
| 12 | 0.15 | 0.015 | 9/128 (partially clogged) | Δ |
| 13 | 0.2 | 0.02 | 5/128 (partially clogged) | x |
| 14 | 0.25 | 0.025 | 23/128 (completely clogged) | x |
| 15 | 0.3 | 0.03 | 69/128 (completely clogged) | x |
| 16 | 0.5 | 0.05 | 128/128 (completely clogged) | x |

Referring to the above results, in a case in that the discharge head having the nozzle diameter being from Φ10 μm to Φ25 μm is used, when the diameter of palladium micro-particle Dp and the nozzle diameter Do satisfy a relationship of $Dp/Do \leqq 0.01$, it is possible to obtain stable droplet jet without clogging. Even if a lower limit of Dp/Do is satisfied, it is difficult to stably disperse remarkable minute metal micro-particles in the solution when the diameter of the palladium micro-particle Dp is equal to or less than 0.001 μm. Moreover, in order for all the discharge heads having the nozzle diameter equal to or less than Φ25 μm to stably conduct the droplet jet, the lower limit of Dp/Do can be set to 0.0002 as a safe limit. That is, if the diameter of the metal micro-particle Dp and the nozzle diameter Do satisfy the relationship of $0.0002 \leqq Dp/Do \leqq 0.01$, a stable dispersed solution can be produced so that the conductive thin film can be formed by the droplet jet using the discharge head which nozzle diameter is equal to or less than Φ25 μm. Therefore, the clogging problem can be prevented.

In this experiment, the discharge opening (nozzle) being round was used. As described above, in a case of another shape, an area of another shape may be simply compared. For example, a 22 μm×22 μm rectangle discharge opening is similar to the discharge opening being round in the present invention. In other words, the present invention can be applied to a case in that the discharge head using the nozzle which area is smaller than 500 $\mu m^2$ and the surface conduction electron-emitting element group is formed by jetting the above-described solution.

Moreover, in this experiment, the discharge head of the thermal jet method (bubble jet™) was used. The discharge head used at the manufacturing apparatus according to the present invention is not limited to the discharge head used in the experiment. The piezo-jet method using the piezoelectric element, the bubble jet™ that generating bubbles by utilizing a thermal energy of a heater, a charge control method (continuous current method), or a like can be applied.

For example, in a case of the piezo-jet method using the piezoelectric element, since a round uniform drop can be obtained by always maintaining an input voltage to a piezoelectric element constantly when the droplet is jetted, it is possible to obtain a proper round dot on the substrate. In Addition, since heat is not utilized like the thermal jet method, the solution to be used can be prevented from a thermal degradation and the solution to be used is less limited.

In a case of the thermal jet method, the solution is jetted while jetting a minute satellite drop. However, advantageously, a jet velocity is faster (for example, 6 m/s through 18 m/s) and a stable jet performance can be obtained. As a result, the minute satellite drop is also jetted at a high speed (6 m/s through 18 m/s) and adheres at the same location on the substrate. Therefore, it is possible to realize a dot having a high accurate dropped location. That is, in a case of the thermal jet method, even if the minute satellite drop is jetted and scattered, when an input energy to the heating element is controlled to be constant, a total solution amount to form one dot becomes constant (since droplet is adhered at the same location). Accordingly, the proper round dot the piezo-jet method can be obtained as the same as the piezo-jet method, the electron emitting device can be obtained at a high grade and high quality. Furthermore, a high accurate location can be obtained.

Figure 8:
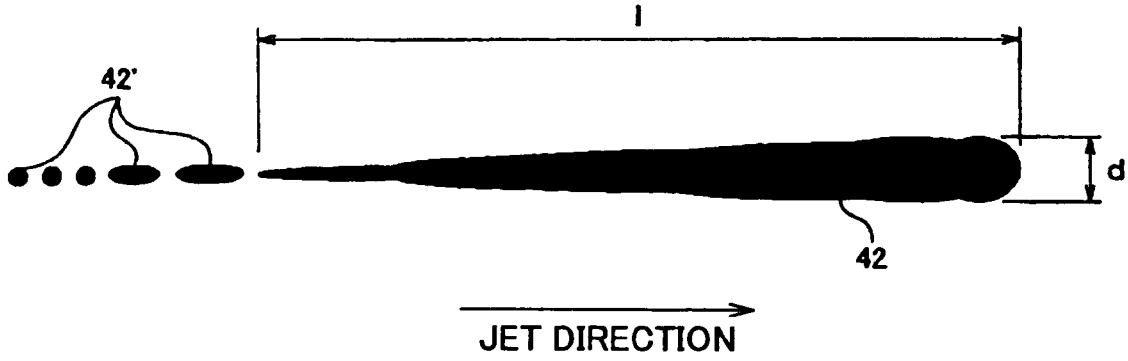
FIG. 8 is a diagram showing a shape of a solution when the solution is jetted in a case of a thermal jet method in that the solution including the metal micro-particle material is jetted from a minute discharge opening by utilizing an action force of a film boiling bubble.
Figure 9:
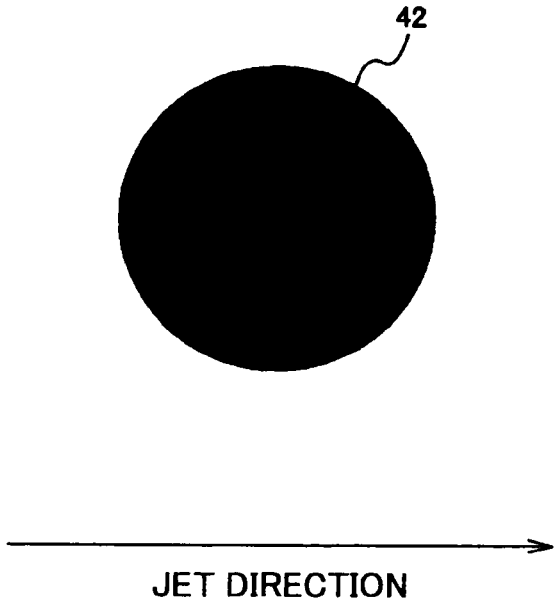
FIG. 9 is a diagram showing a shape example of the solution in a case of a piezo-jet type of jetting by an action force caused by a mechanical displacement by the discharge head used for the electron-emitting device manufactureing apparatus according to the present invention.
Figure 10:
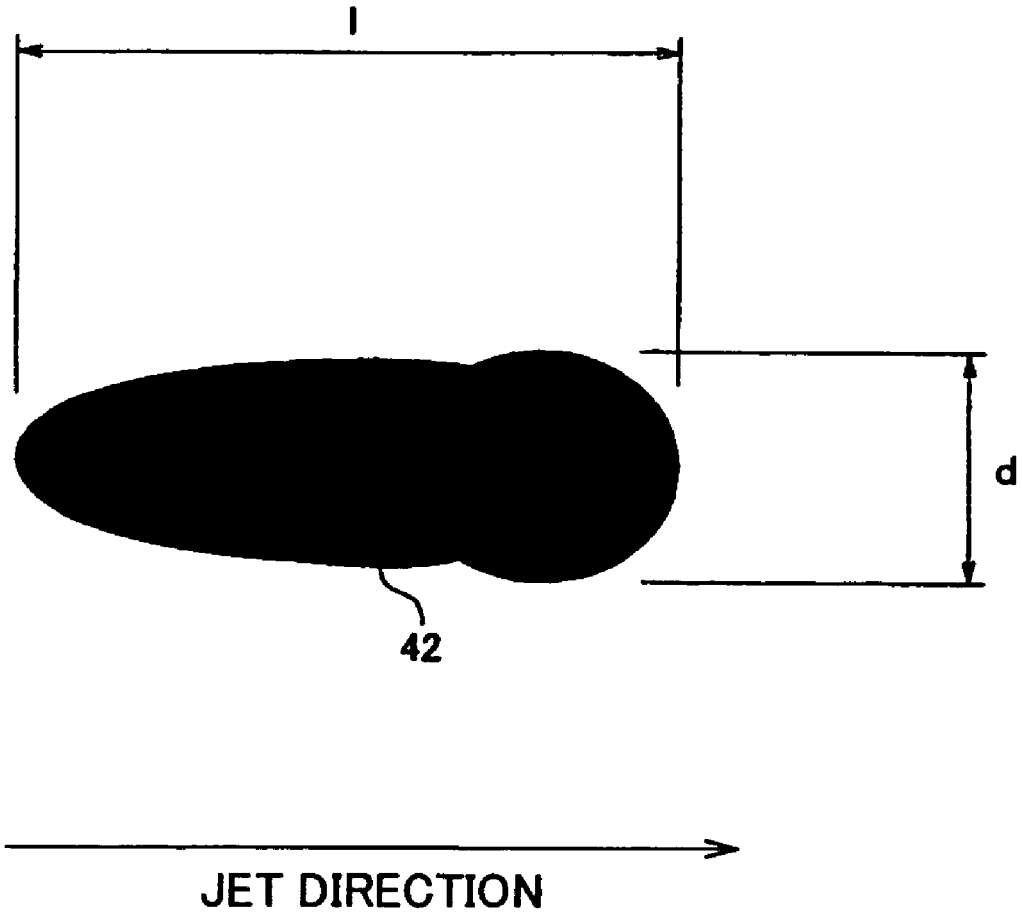
FIG. 10 is a diagram showing another shape example of the solution in a case of a piezo-jet type of jetting by an action force caused by a mechanical displacement by the discharge head used for the electron-emitting device manufactureing apparatus according to the present invention.

FIG. 8 is a diagram showing a shape of the solution when the solution is jetted in a case of the thermal jet method in that the solution including the metal micro-particle material is jetted from the minute discharge opening by utilizing a growth action force of a film boiling bubble. FIG. 9 and FIG. 10 are diagrams showing a shape of the solution when the solution is jetted in the piezo-jet method for jetting by a mechanical action force in that the piezoelectric element is recognized as a moving force of discharging a droplet.

In cases shown in FIG. 9 and FIG. 10, different from the case shown in FIG. 8, a jet pressure is higher and a jet velocity is faster than the piezo-jet method for jetting by the mechanical action force in that the piezoelectric element in FIG. 9 and FIG. 10 is defined as the moving force of the droplet discharge in order to immediately heat a part of the solution at from 300° C. to 400° C. (within a few μs), to occur the film boiling bubble, and to jet the solution by utilizing an immediate growth (within a few μs) and a pressure increase (action force) of the film boiling bubble. As a result, as shown in FIG. 8, a jet shape of the solution has features in that the droplet 42 extends in a jet direction while forming to be a slender pole shape and the solution is jetted with a plurality of minute droplets at a rear portion thereof at a high speed, when the solution is jetted. For example, generally, when the solution is jetted by producing a stable film boiling bubble, a length 1 of the slender pole shape of the jet shape of the solution becomes more than five times a diameter d and the solution is jetted approximately at from 6 m/s to 18 m/s.

As a result, advantageously, the jet can be stable and the dropped location of a jetted solution is accurately positioned on the substrate. On the other hand, if a relative movement velocity between the discharge head and the substrate is not selected, the droplet 42 forming the slender pole shape and extending toward the rear portion in the jet direction and the plurality of minute droplets following at the rear portion prevent to form the proper round dot.

As a result of careful consideration with regard to this point, the inventor found it that it is necessary to optimize the relationship between the jet velocity and a relative movement velocity in a case in that such the solution including the metal micro-particle material is jetted.

In a case in that the solution including the metal micro-particle material is jetted and an electron emitting device pattern is formed while maintaining the discharge head unit 11 toward the substrate 14 at a constant distance and conducting the relative displacement in the x and y directions, the solution adheres on the substrate 14 at a speed of a composition vector of the relative speed and the jet velocity and then the electron emitting device pattern is formed. As for the location accuracy, a distance from the discharging opening of the discharge head unit 11 to the substrate 14 and the speed of the composition vector are considered, and then the solution can adhere at the target location by properly selecting a jet timing.

However, even if the solution adheres at the target location, the adhered solution is flowed on the substrate 14 by a force of the relative speed when the relative speed is faster and the proper dot shape is not formed. Accordingly, the electron emitting device pattern cannot be properly formed. Moreover, the plurality of minute droplets (satellite minute droplet) chaining toward the rear portion is displaced from the target location and randomly adheres in a scatter state. Accordingly, it is prevented to form the proper dot shape and an electron emitting device performance is deteriorated. These disadvantages are considered in the present invention.

Next, one of examination will be described. In this examination, a similar apparatus shown in FIG. 4 was used, and an x direction movement velocity of a carriage 12, and the jet velocity of the discharge head unit 11 were changed. Then, it was checked whether or not the solution properly adhered on the substrate 14 and the electron emitting device pattern was properly formed.

Figure 11A:
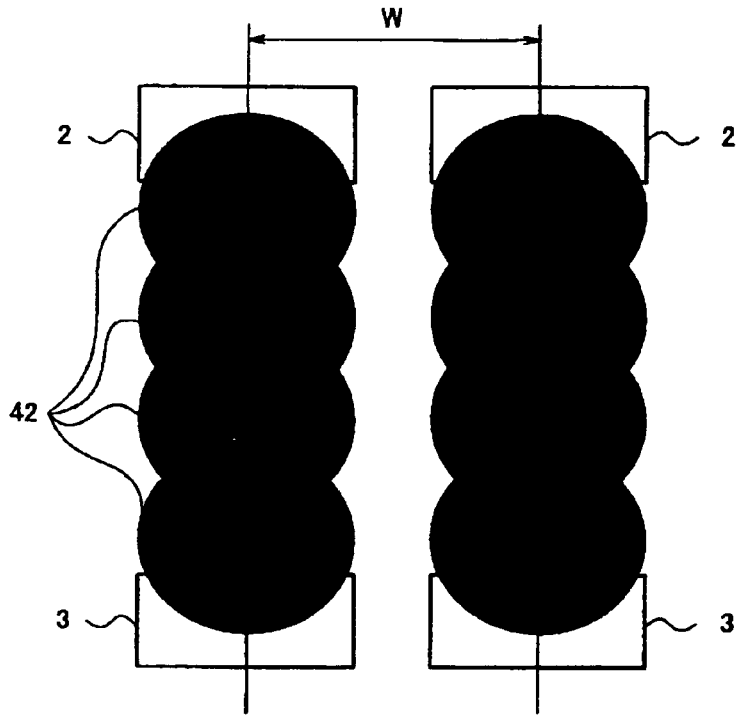
FIG. 11A and FIG. 11B are diagrams showing test patterns used to find out a condition for conducting a proper pattern formation.
Figure 11B:
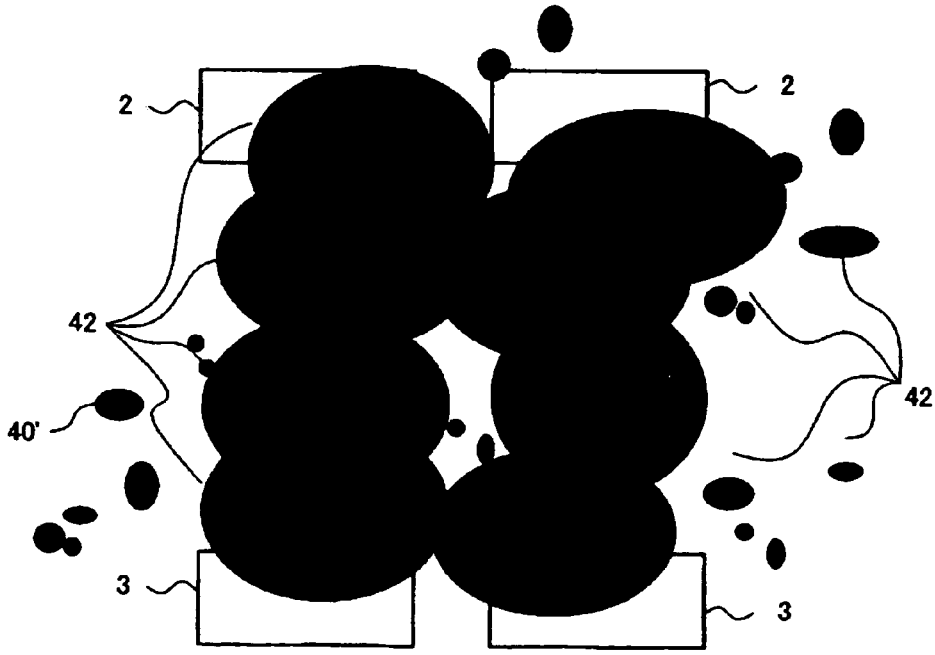

FIG. 11A and FIG. 11B are diagrams showing patterns used in the examination. In this case, the solution including the palladium micro-particles was jetted, the electron emitting device pattern connecting the droplets 42 formed by the solution was formed on two electrodes 2 and 3 (between an ITO transparent electrodes) being adjacent each other. Then, a formation state of the electron emitting device pattern was evaluated. This evaluation was conducted by observing the electron emitting device pattern by using a microscope and it was checked whether or not the electron emitting device pattern was properly formed. In FIG. 11A, a proper formation is shown. In FIG. 11B, each dot patter is not formed to be a proper round. When the dot patter becomes oval, displaces from the target location on the substrate, or contacts with an adjacent dot, it is determined that the dot pattern is not properly formed. Moreover, when the plurality of minute droplets originated from the droplet 42 is observed, it is determined that the dot pattern is not properly formed.

In addition to this evaluation of the dot shape, a resistance value was measured at an upside and a downside between the ITO transparent electrodes, and a resistance value fluctuation by a disconnection caused by an imprecise dot location or a contact with the adjacent dot (right or left dot) was evaluated ("o" denotes an on-target resistance and "x" denotes an out-target resistance).

Details of an experimental condition will be described. A substrate used in this experiments was a glass substrate attached with the ITO transparent electrode, and a pattern was formed so as to embed a pair of the ITO transparent electrodes 2 and 4 as shown in FIG. 11A and FIG. 11B by four dots by combining the solution including the palladium micro-particles with the discharge head shown in FIG. 7A through FIG. 7C. In this experiment, the palladium micro-particle having a 0.01 μm diameter was used, and a multi nozzle plate by an Ni electro-forming providing with a Φ15 μm opening was additionally provided. In addition, a similar pattern was formed to connect the ITO transparent electrode and between the ITO transparent electrodes in that a center-to-center distance w was defined as 25 μm, adjacently to the pattern.

The discharge head used in this experiment was the discharge head above-described (four nozzles are simply shown in FIG. 7 through FIG. 7C) but included 64 nozzles (discharge openings). In addition, the arrangement density was 400 dpi. The size of the heating element was 10 μm×40 μm, and the resistance value was 102Ω. The drive voltage of the head was 12V, the pulse width was 3 μs, and the drive frequency was 14 kHz. A volume of a discharge droplet was approximately 3 pl.

Under this experimental condition, the pattern above-described was formed on the glass substrate. After the pattern was formed, the pattern was evaluated. In addition, under the same experimental condition, another discharge experiment was conducted, and then a discharge state of the solution being 3 mm away from the discharge opening was observed. Because the pattern of the electron emitting device shown in FIG. 11A and FIG. 11B was produced in that a distance was set as 3 mm between the substrate and the discharge opening. As shown in FIG. 8, the jet state was the droplet 42 forming the pole shape (1=5*d* to 20*d*) considerably extended in the jet direction. The jet state also showed the droplet 42 accompanying with the plurality of minute droplets at the rear portion in the jet direction. The result of this experiment will be shown as follows:

TABLE 10

| Experiment No. | Jet Velocity Vj(m/s) | X Direction Movement Velocity Of Carriage Vc(m/s) | Pattern Formation State | Resistance |
|---|---|---|---|---|
| 1 | 6 | 1 | ○ | ○ |
| 2 | 6 | 2 | ○ | ○ |
| 3 | 6 | 3 | x | x |
| 4 | 6 | 4 | x | x |

TABLE 10-continued

| Experiment No. | Jet Velocity Vj(m/s) | X Direction Movement Velocity Of Carriage Vc(m/s) | Pattern Formation State | Resistance |
|---|---|---|---|---|
| 5 | 6 | 6 | x | x |
| 6 | 6 | 8 | x | x |
| 7 | 6 | 10 | x | x |
| 8 | 6 | 12 | x | x |
| 9 | 9 | 1 | ○ | ○ |
| 10 | 9 | 2 | ○ | ○ |
| 11 | 9 | 3 | ○ | ○ |
| 12 | 9 | 4 | x | x |
| 13 | 9 | 6 | x | x |
| 14 | 9 | 8 | x | x |
| 15 | 9 | 10 | x | x |
| 16 | 9 | 12 | x | x |
| 17 | 12 | 1 | ○ | ○ |
| 18 | 12 | 2 | ○ | ○ |
| 19 | 12 | 3 | ○ | ○ |
| 20 | 12 | 4 | ○ | ○ |
| 21 | 12 | 6 | x | x |
| 22 | 12 | 8 | x | x |
| 23 | 12 | 10 | x | x |
| 24 | 12 | 12 | x | x |
| 25 | 18 | 1 | ○ | ○ |
| 26 | 18 | 2 | ○ | ○ |
| 27 | 18 | 3 | ○ | ○ |
| 28 | 18 | 4 | ○ | ○ |
| 29 | 18 | 6 | ○ | ○ |
| 30 | 18 | 8 | x | x |
| 31 | 18 | 10 | x | x |
| 32 | 18 | 12 | x | x |

Referring to the result shown in Table 10, when the x direction movement velocity of the carriage is greater than ⅓ the jet velocity, a proper device cannot be formed. In this experiment, a state of carrying the discharge head to scan is illustrated. Alternatively, this experiment can be applied in a case in that the discharge head can be fixed as shown in FIG. 5 and the substrate is moved. That is, in a case of jetting by the thermal jet method, the relative movement velocity between the discharge head and the substrate is required to be equal to or less than ⅓ velocity of the solution that is to jet.

Another feature of the present invention will be further described. The electron-emitting device to be manufactured according to the present invention is manufactured by jetting in the air the solution including the metal micro-particle material, in which a infinite number of minute metal micro-particles and metal nano micro-particles are dispersed, in accordance with the ink-jet principle, and by providing the droplet on the substrate. In order to manufacture the electron-emitting device at a high precision and a high grade, it is required to jet and provide the solution including the metal micro-particle material on the substrate, and to optimize a roughness of a substrate surface where a minute dot pattern is formed and the size of the metal micro-particle.

Figure 12:
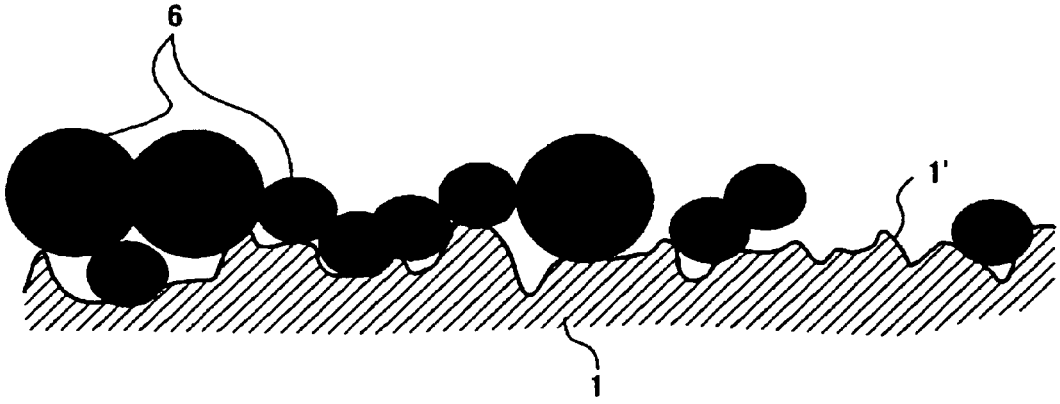
FIG. 12 is a diagram illustrating a relationship between a metal micro-particle and a roughness of a surface in a case in that a dot pattern is formed by a solution including the metal micro-particle being larger than the roughness of the surface of the substrate.
Figure 13:
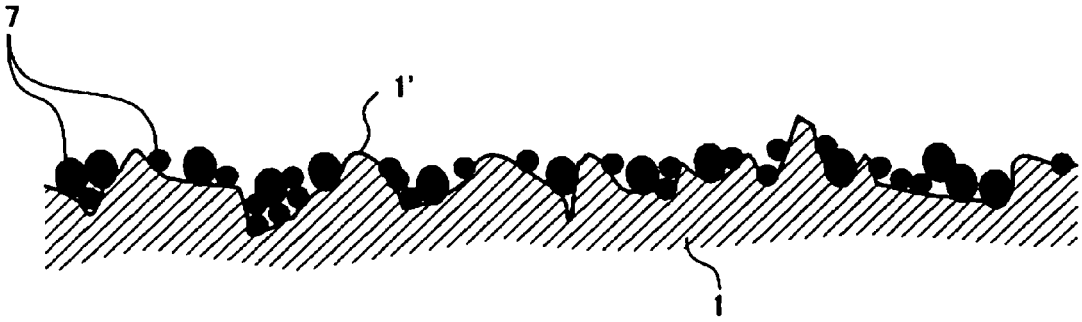
FIG. 13 is a diagram illustrating a relationship between a metal micro-particle and a roughness of a surface in a case in that a dot pattern is formed by a solution including the metal micro-particle being smaller than the roughness of the surface of the substrate.

For example, the roughness of the substrate surface is concavity and convexity of the substrate surface. As shown in FIG. 12, if a particle 6 larger than the concavity and convexity of a surface 1' of the substrate 1 adheres on the surface 1' of the substrate 1, the proper dot pattern cannot be obtained. As shown in FIG. 13, if a particle 7 smaller than the concavity and convexity of a surface 1' of the substrate 1 adheres on the surface 1' of the substrate 1, the proper dot pattern can be obtained. Considering this point in the present invention, the droplet 42 (dot pattern) was formed on the substrate 1 which roughness of the surface was known beforehand, by each of solutions including the metal micro-particles having a different size. After the dot pattern is formed, the dot pattern was evaluated.

In this experiment, a pyrex™ glass was polished so as to be from 0.01 s to 0.02 s in roughness of the surface. The solution including the palladium micro-particles (in this case, the diameter of the micro-particle being from 0.002 μm to 0.2 μm was used) was combined with the liquid discharge head of the thermal jet method (bubble jet™ method) using growth action force of the film boiling bubble immediately occurring the moving force or the droplet jet as shown in FIG. 7A through FIG. 7C in the solution. Then, a pattern chaining dots were formed. Smoothness of the pattern was observed by using the microscope, a sensory evaluation was conducted, and then it was determined whether the pattern was excellent "o", good "Δ", or defect "x".

In this examination, a type in that the nozzle 58 serves as a flow path as shown in FIG. 7A through FIG. 7C was not applied but a discharge head, to which a nozzle hole was additionally provided on a surface of the nozzle 58, was used. That nozzle was a round nozzle formed by the Ni electroforming, the size of the nozzle was Φ15 μm, and the thickness of an opening part was 13 μm.

In addition, 64 nozzles were provided and the arrangement density was 400 dpi. The size of the heating element was 10 μm×40 μm, and the resistance value 100Ω. The drive voltage of the head was 12V, the pulse width was 3 μs, and the drive frequency 14 kHz. The quantity of one droplet was approximately 3 pl.

As shown in FIG. 11A through FIG. 11B, the pattern was formed to form one line between the ITO transparent electrodes 2 and 3 formed at an 20 μm interval at an upsid and a douside on pyrex™ glass, by jetting four dots being approximate Φ18 μm at approximate 8 μm pitch.

In order to obtain 8 μm pitch between dots, the discharge head and the substrate were relatively moved (in this examination, the substrate was fixed and the carriage scanning movement was conducted for the discharge head), and a location to move was controlled by a μ order. A jet timing was controlled and a dot was formed at approximate 8 μm pitch. In addition, a similar pattern was formed to connect the ITO transparent electrode and between the ITO transparent electrodes in that a center-to-center distance was defined as 25 μm, adjacently to the pattern.

Under this experimental condition, the pattern above-described was formed on the glass substrate. After the pattern was formed, the pattern was evaluated. In addition, under the same experimental condition, another discharge experiment was conducted, and then a discharge state of the solution being 3 mm away from the discharge opening was observed. Because the pattern of the electron emitting device shown in FIG. 11A and FIG. 11B was produced in that a distance was set as 3 mm between the substrate and the discharge opening. As shown in FIG. 8, the jet state was the droplet forming the pole shape (1=5*d* to 20*d*) considerably extended in the jet direction. The jet state also showed the droplet accompanying with the plurality of minute droplets at the rear portion in the jet direction.

As described above, solutions including the palladium micro-particles having a different diameter in a range from 0.002 μm to 0.2 μm were prepared and used (a solution No is in common with previously described tables). In a case in that the diameter of the micro-particle was greater than 0.02 μm, the nozzle started to be clogged. Accordingly, only the patterns, which was not clogged and was properly formed, were selected from all patterns formed on the substrate 1, and were evaluated. A result of this experiment will be shown as follows:

TABLE II

| Solution No. | Diameter Of Palladium Micro-particle Dp(mm) | Determination |
|---|---|---|
| 5 | 0.002 | o |
| 6 | 0.004 | o |
| 7 | 0.006 | o |
| 8 | 0.009 | o |
| 9 | 0.02 | Δ |
| 10 | 0.05 | x |
| 11 | 0.07 | x |
| 12 | 0.1 | x |
| 13 | 0.15 | x |
| 14 | 0.2 | x |

Referring to the table 11 showing the result, if the size of the metal micro-particle included in the solution is smaller than the size of the roughness of the surface of the substrate where the pattern formed, the dot pattern can be formed smoothly and properly at a high precision. On the other hand, if the size of the metal micro-particle is greater than the size of the roughness of the surface of the substrate, the smoothness of the dot pattern is impaired, and the electron emitting device can not be properly manufactured.

In other words, in order to properly form the smooth pattern and obtain a favorite electron emitting device, it is required to make the roughness of the surface of the substrate where the pattern is formed much rougher than the size of the metal micro-particles included in the solution. However, the roughness of the surface of the substrate is visually in a mirror surface state since the metal micro-particle used in the present invention is a remarkably minute nano micorparticle. Thus, it is needed to polish the substrate at higher precision. In a case in that a substrate where a film such as $SiO_2$ is formed is used, in order to obtain a smooth $SiO_2$ surface, it is required to carefully conduct a film formation (for example, such as a sputtering or a like) with plenty of time. That is, it results in higher cost of manufacturing the substrate.

Considering the electron-emitting device according to the present invention as a substrate at which one side the patter is formed, only one surface where the pattern is formed is required to be smooth. That is, it is simply required to carefully polish only a front side surface (where the pattern is formed) to be a fine mirror surface and a back side surface of the substrate may be left to be a rougher surface than the front side surface.

In other words, in the present invention, by using the substrate which the back side surface is made to be rougher than the front side surface where the pattern is formed, it is possible to obtain the electron-emitting device where the electron emitting device is formed at a high precision and also it is possible to lower the cost of manufacturing the substrate. For example, the back side surface is made to be one digit rougher than the front side surface (where the pattern is formed). For example, when the front surface is made to be from 0.01 s to 0.02 s, the back side surface is made to be from 0.1 s to 0.2 s. Then, it can be realized to lower the cost of manufacturing the substrate. Furthermore, when the back side surface is made to be rougher than 0.1 s to 0.2 s, almost a cost is substantially required to make the front side surface be a proper smooth surface. Accordingly, it is possible to reduce half cost of polish both the front side surface and the back side surface at a high precision. It should be noted that a upper limit of the roughness of the back side surface is not unlimited and a quality of the substrate should be maintained as an industrial product satisfying a certain standard.

Next, other feature of the present invention will be described. As above-described, in the present invention, the solution including the metal micro-particle material in which the metal micro-particles are dispersed is jetted in the are and adheres on the substrate so as to form the pattern, and the electron emitting device is manufactured. In order to obtain a high grade electron emitting device, it is important to consider the thickness of a pattern of an electron emission part formed by a residual solid content after a volatile component in a dot pattern formed by a droplet or the solution after the solution is jetted and adheres is vaporized. For example, the substrate where the electron emitting device is formed has a surface having a certain roughness. Then, it is required to properly select a relationship between the thickness of the pattern and the roughness of the surface, that is, a relationship between the thickness of the pattern and a concavity and convexity of the surface. A result of this examination will be described.

In this experiment, the pyrex™ glass substrate having different roughness of the surface, a pair of the electrodes were formed on the pyrex™ glass substrate, the solution including the palladium micro-particles were jetted by the discharge head H3 so as to form a pattern connecting with a plurality of dots, and a device was formed by conducting a forming process that will be described later. Then, it was evaluated whether or not the device actually functions properly ("o" denotes that proper electron emission was obtained and "x" denotes that the proper electron emission was not obtained).

In order to change a pattern film thickness, the solution, in which the No. 6 solution (the diameter of the palladium micro-particle Dp=0.006 μm) was diluted 2 to 50 times with purified water was used. As a result, the pattern was formed by jetting and providing the solution on the substrate. After the pattern is dried and solid content is remained, each electron emitting device, which pattern film thickness is different, could be formed.

Next, detail experiment condition will be described. The pattern was formed by applying a dot being approximate Φ18 μm at 8 μm pitch four times in one line in a longitudinal direction.

The discharge head and the substrate were relatively moved each other (in this experiment, the substrate was fixed but the discharge head was moved by the carriage scanning movement), this control was conducted by a μ order, and the jet timing was controlled. Then, the dots adhered at 8 μm pitch as described above.

The size of the nozzle of the discharge head used in this experiment was Φ15 μm, the thickness of an opening part was 13 μm, 64 nozzles were used, and the arrangement density was 400 dpi. The size of heating element was 10 μm×40 μm and the resistance value was 100Ω. The drive voltage of the discharge/head was 12V, the pulse width was 3 μs, the drive frequency was 14 kHz. Under this experiment condition, the quantity of one droplet to jet was approximately 3 pl. A result will be described in the following.

TABLE 12

| No. | Roughness Of Substrate Surface (s) | Thickness Of Pattern (μm) | Determination |
|---|---|---|---|
| 1 | 0.02 | 0.005 | x |
| 2 | 0.02 | 0.01 | x |
| 3 | 0.02 | 0.02 | o |
| 4 | 0.02 | 0.05 | o |

TABLE 12-continued

| No. | Roughness Of Substrate Surface (s) | Thickness Of Pattern (μm) | Determination |
|---|---|---|---|
| 5 | 0.02 | 0.1 | o |
| 6 | 0.05 | 0.01 | x |
| 7 | 0.05 | 0.02 | x |
| 8 | 0.05 | 0.05 | o |
| 9 | 0.05 | 0.1 | o |
| 10 | 0.05 | 0.5 | o |
| 11 | 0.1 | 0.02 | x |
| 12 | 0.1 | 0.05 | x |
| 13 | 0.1 | 0.1 | o |
| 14 | 0.1 | 0.5 | o |
| 15 | 0.1 | 1 | o |

Referring to the result, in the electron emitting device formed in accordance with the principle of the present invention, when the thickness of the pattern of the electron emission part is defined to be thicker than the roughness of the surface of the substrate, it is possible to obtain the proper electron emitting device.

In a case of forming the electron emitting device by combining such round dot patterns, in order to function as the proper electron emitting device, not only a round dot patter is properly formed but also a pattern formed by combining the proper round dot patterns are required to be properly formed.

A formation of the electron emitting device will be described with reference to FIG. 14A through FIG. 14E. FIG. 14A through FIG. 14E are diagrams illustrating the formation of the electron emitting device according to the embodiment of the present invention. In FIG. 14A through FIG. 14E, in accordance with the principle of the present invention, a solution in which the metal micro-particles are dispersed is jetted to form the droplet 42 being a round dot pattern between the ITO transparent electrodes 2 and 3 formed on the substrate, and the electron emitting device is formed. In FIG. 14A through FIG. 14E, Ld denotes the diameter of the dot when a single dot is formed alone, and Pd denotes the center-to-center distance (dot pitch) between two adjacent dots.

Figure 14A:
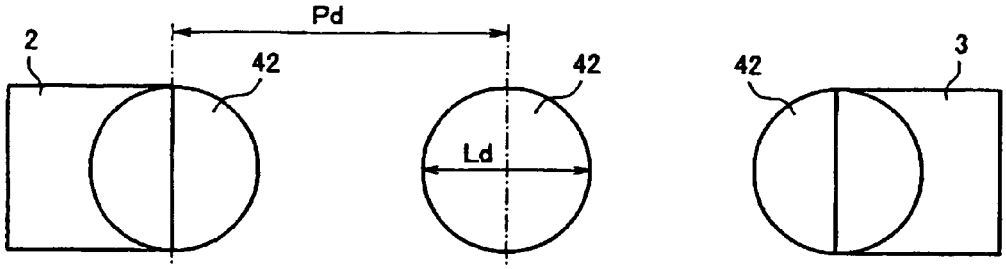
FIG. 14A through FIG. 14E are diagrams illustrating a formation of the electron emitting device according to the embodiment of the present invention.
Figure 14B:
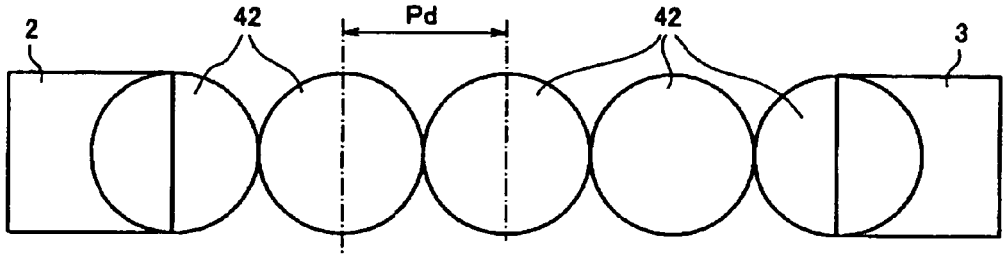
Figure 14C:
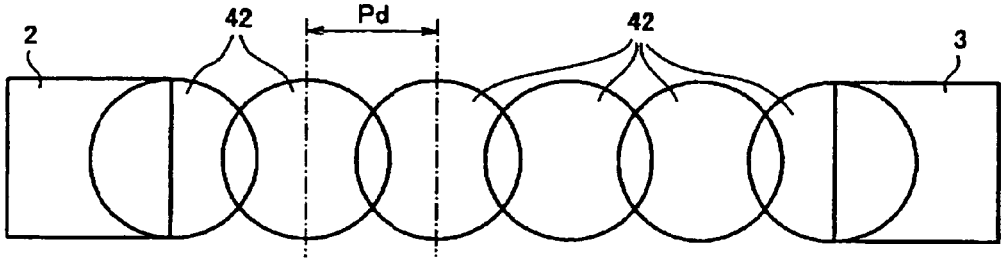
Figure 14D:
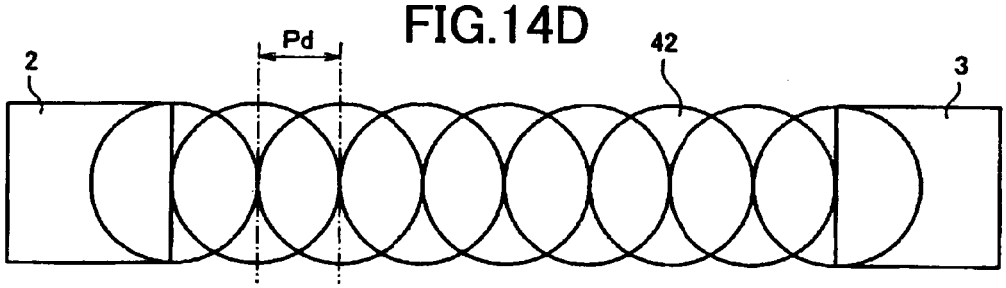
Figure 14E:
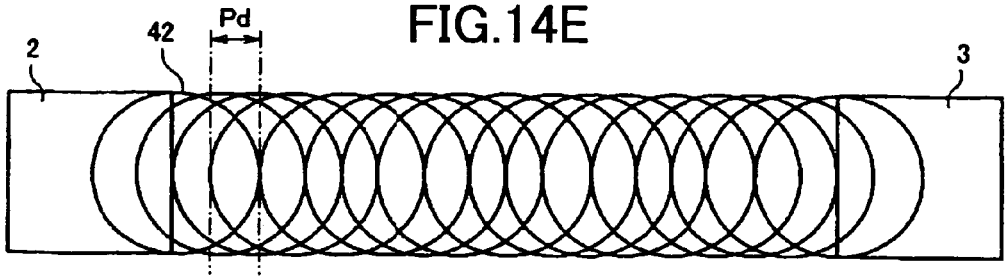

In FIG. 14A, a case, in which three droplets 42 as three dots are formed between two ITO transparent electrodes 2 and 3, is illustrated. In this case, a problem in that two ITO transparent electrodes 2 and 3 are not electrically connected with each other (Pd>Ld) since a formation density is too rough to electrically connect two ITO transparent electrodes 2 and 3 each other. Accordingly, in this case, it can not be function as a proper device. FIG. 14B illustrates a case in that the droplets 42 (dots) are barely connected with each other electrically at each peripheral part (Pd=Ld). FIG. 14C illustrates a case in that the droplets 42 are overlapped and electrically connected with each other at each the peripheral part (Pd<Ld), more than the case illustrated in FIG. 14B. FIG. 14D and FIG. 14E illustrate cases in that each overlap area becomes much larger.

Considering a viewpoint simply whether or not an electronic connection can be obtained, the case illustrated in FIG. 14A is not necessary to consider. In the cases illustrated in FIG. 14B through FIG. 14E, at least the electronic connection is achieved. However, as the cases illustrated in FIG. 14B and FIG. 14C are considered as a single line pattern formed by combining a plurality of round dots in one line, a width of the line pattern (a width in a longitudinal direction) becomes narrower between the adjacent dots (an area where the adjacent dots overlap with each other), and then the disconnection can be caused at high possibility. For example, in the case in that the adjacent dots are barely connected with each other at the peripheral part as shown in FIG. 14B, this connection is likely to be disconnected immediately when an electronic signal is applied. Accordingly, this connection can not be practical at all. Similarly, in the case illustrated in FIG. 14C, this connection may be used at the beginning but cannot be durable for a long term use.

In the present invention, in order to solve these problems, two adjacent dots are surely overlapped with more than one dot. Even if adjacent droplets 42 (dots) are barely connected with each other at the peripheral parts, by overlapping one dot at a center between the adjacent droplets 42, the width of the line pattern in the overlap area becomes maximum, that is, a with of one dot (Ld), since one dot is further overlapped on the overlap area.

As described above, a condition of overlapping the adjacent drops with each other by the overlap area of one dot is determined to apply the dot at a density equal to or less than Ld/2 where Ld denotes the diameter of dot when a single dot is formed alone.

Accordingly, it is possible to form the line pattern having an excellent long term reliability without the disconnection, and an outline of the line pattern can be less concavity and convexity and be smooth. This can be seen obviously by comparing the cases as shown in FIG. 14B and FIG. 14C in that the round dots are applied at a density at which the electronic connection can be barely obtained, with the cases as shown in FIG. 14D and FIG. 14E in that in addition to the density at which the electronic connection can be obtained, more than one dot is further applied to fill between the adjacent dots. In the latter cases, the outline of the line pattern can be less concavity and convexity and be smooth more, and it is possible to obtain an excellent electron emitting device being less disordered.

As shown in FIG. 14A through FIG. 14E, the present invention can be applied to a case in that the dots (droplets 42) are arranged in one line in the line pattern of a final electron emitting device.

Figure 15:
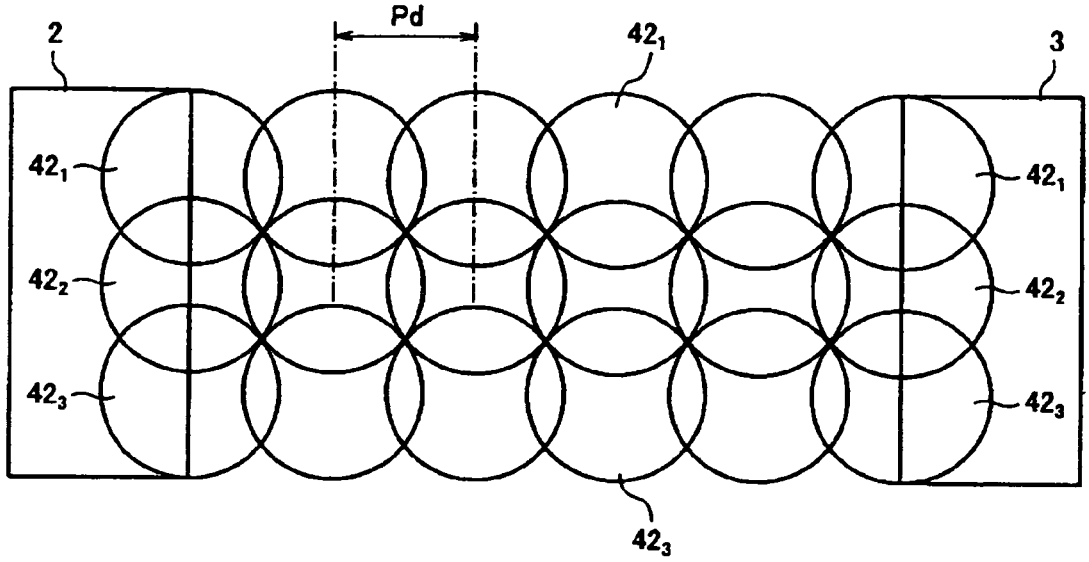
FIG. 15 is a diagram for explaining a method for forming a thicker electron emitting device pattern by arranging a plurality of dot lines formed by the droplets or the solution.

For example, a line pattern as shown in FIG. 15 can be formed by the electron-emitting device manufacturing apparatus according to the present invention. In this case, the dots are arranged in one line in a lateral direction and three lines are provided in parallel so as to obtain a relatively thick line pattern. That is, this is a case in that only one line is likely to be disconnected.

Accordingly, since three lines (or two lines) are provided in parallel, the disconnection can be prevented and the function can be properly conducted. Therefore, in the case that a plurality of lines (for example, three lines) are provided in parallel, the round dots are simply applied at the density at which the electronic connection can be obtained. Even if there is no dots to fill between the adjacent dots, since the plurality of lines are provided in the longitudinal direction (in a line pattern width direction), the disconnection cannot be caused.

That is, the condition of providing more than one dot to fill between the adjacent dots is required to apply to a case of arranging the plurality of the dots of the droplets 42 or the solution to form more minute electron emitting device.

In this experiment described above, the ITO transparent electrodes were applied as two electrodes. However, it is not limited to the ITO transparent electrodes. Alternatively, an Al, Au, Cu, or a like material can be properly applied.

Next, a further feature of the present invention will be described. The present invention is a technology for manufacturing the electron emitting device. The electron emitting device formed on the substrate is generally formed by jetting the solution including the metal micro-particle material on the pair of electrode patterns previously formed on the substrate, and forming the round dot pattern. When the solution including the metal micro-particle material is further jetted on the pattern that is preciously formed and the electronic connection between this pattern and the previous electrode pattern is conducted, this quality is important. The quality of the formation of the electron emitting device will be described with reference to FIG. 16A through FIG. 16D.

FIG. 16A through FIG. 16D are diagrams illustrating the formation of the electron emitting device. In FIG. 16A through FIG. 16D, by the principle of the present invention, between two ITO transparent electrodes 2 and 3 formed on the substrate, the solution including the metal microparticle material is jetted, the plurality of the droplets 42 being the round dot pattern is formed, and then the electron emitting device is formed. In FIG. 16A through FIG. 16D, Ld denotes the diameter of the dot in a case a single dot is formed on the substrate alone.

Figure 16A:
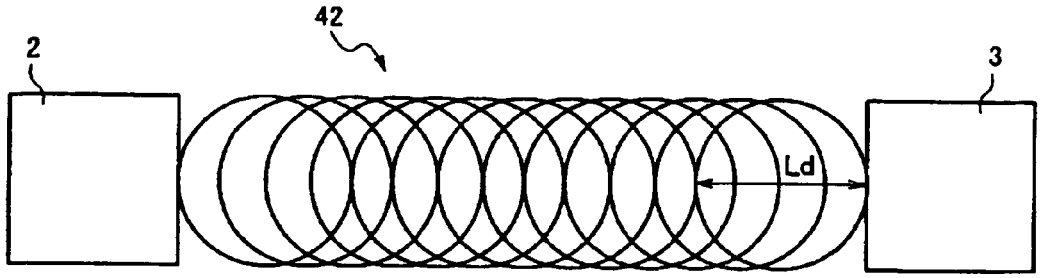
FIG. 16A through FIG. 16D are diagrams illustrating the formation of the electron emitting device.
Figure 16B:
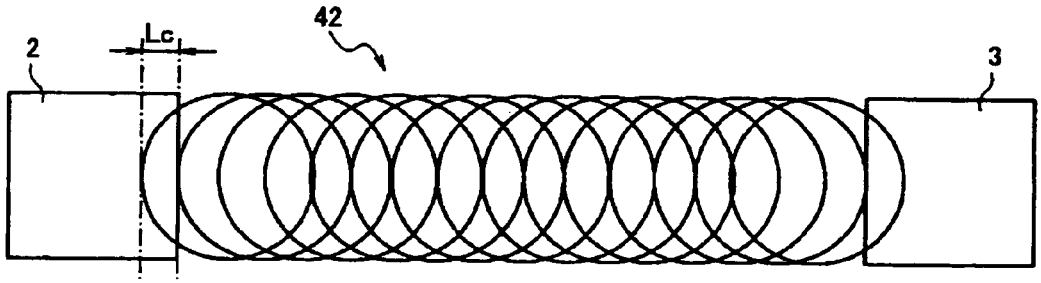
Figure 16C:
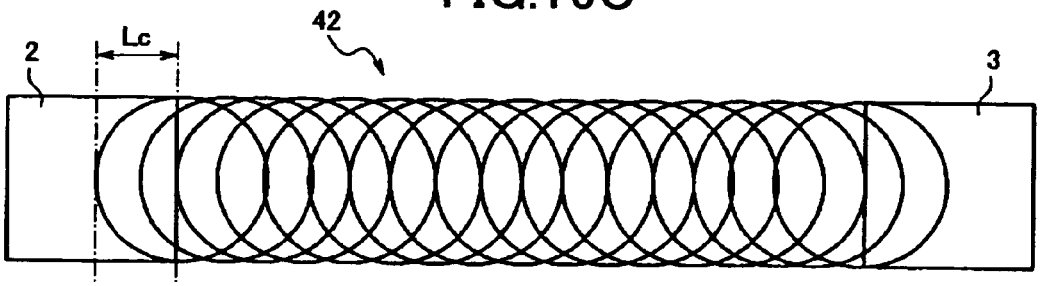
Figure 16D:
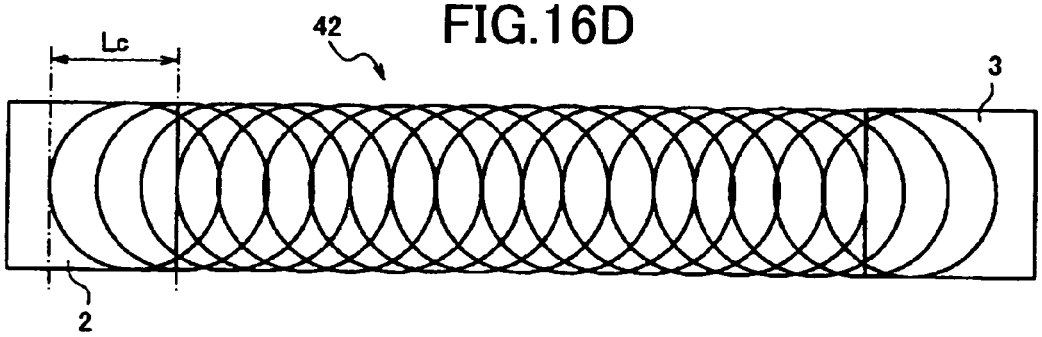

FIG. 16A illustrates a case in that the solution including the metal micro-particle material is jetted between the two ITO transparent electrodes to form the dot pattern and the two ITO transparent electrodes 2 and 3 are barely connected electrically at both a right end and a left end of the dot pattern. FIG. 16B illustrates a case in that the droplets 42 are overlapped and electrically connected with each other at each the peripheral part more than the case illustrated in FIG. 16A and Lc denotes a length of an overlap area overlapping each of the ITO transparent electrodes 2 and 3 with the dot pattern. FIG. 16C and FIG. 16D illustrate cases in that each overlap area becomes much larger and the length Lc becomes longer.

Considering a viewpoint simply whether or not an electronic connection can be obtained, in the cases illustrated in FIG. 16A through FIG. 16B, at least the electronic connection is achieved. However, this connection is likely to be disconnected immediately when an electronic signal is applied. Even if this connection is not immediately disconnected, since a contact resistance of a connection part is extremely high, the connection part generates heat. Accordingly, the long term reliability cannot be expected because of this heat. A disconnection can be caused in future. Thus, an original performance can not be achieved.

In order to solve the above-described problem, in the present invention, when the solution including the metal micro-particle material is jetted with respect to the pattern previously formed on the substrate so that the dot pattern is formed, as shown in FIG. 16C and FIG. 16D, at the connection area, a dot is applied to an end of the dot pattern so as to cover the pattern previously formed by more than half the dot. In other words, the size of the discharge opening (solution jet quantity) and a method for applying the dot are determined so that a relationship between Ld and Lc is satisfied to be $Ld/2 \leqq Lc$ where Ld denotes the diameter of the dot in a case a single dot is formed on the substrate alone.

Figure 17:
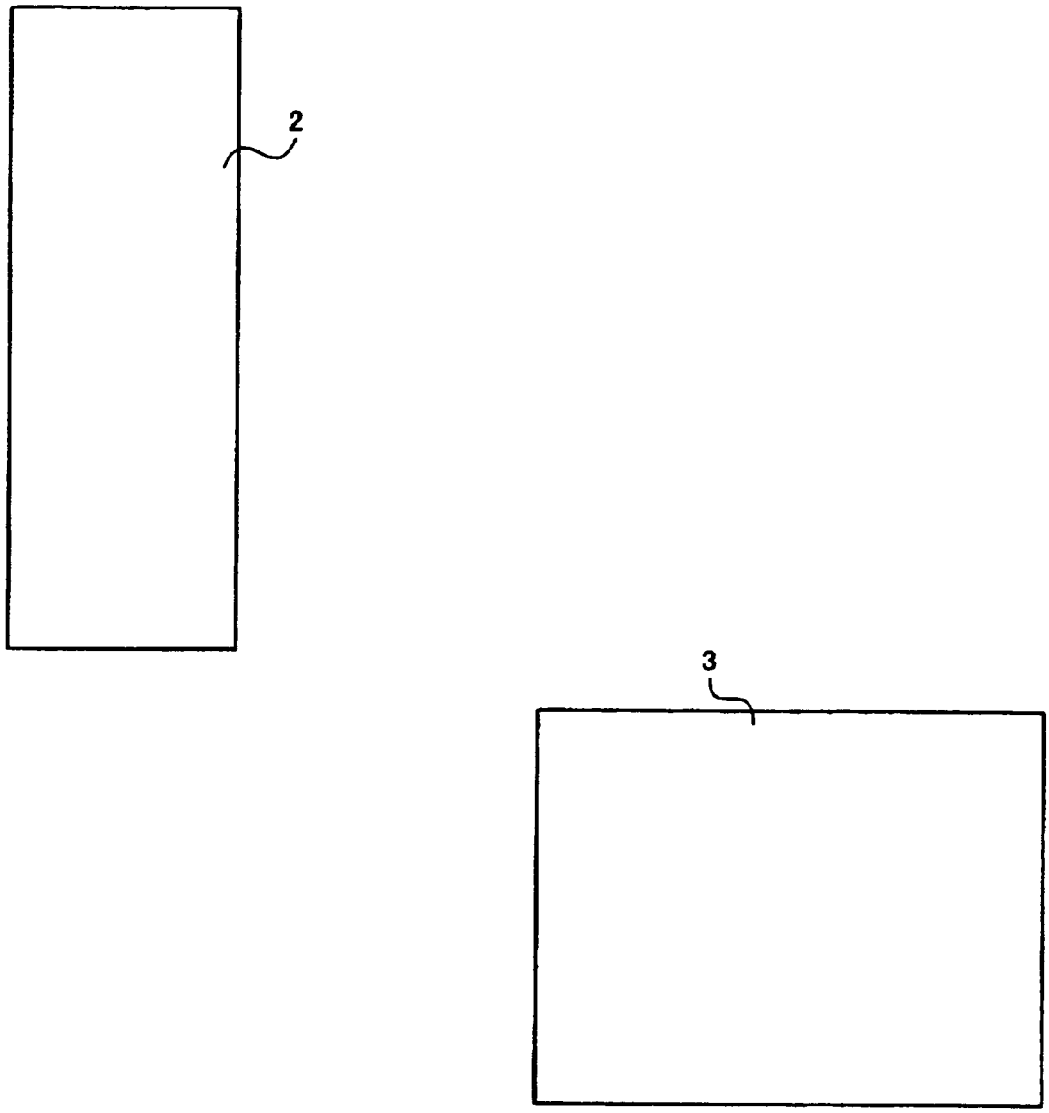
FIG. 17 is a diagram illustrating a pattern of two ITO transparent electrodes formed on the substrate.
Figure 18:
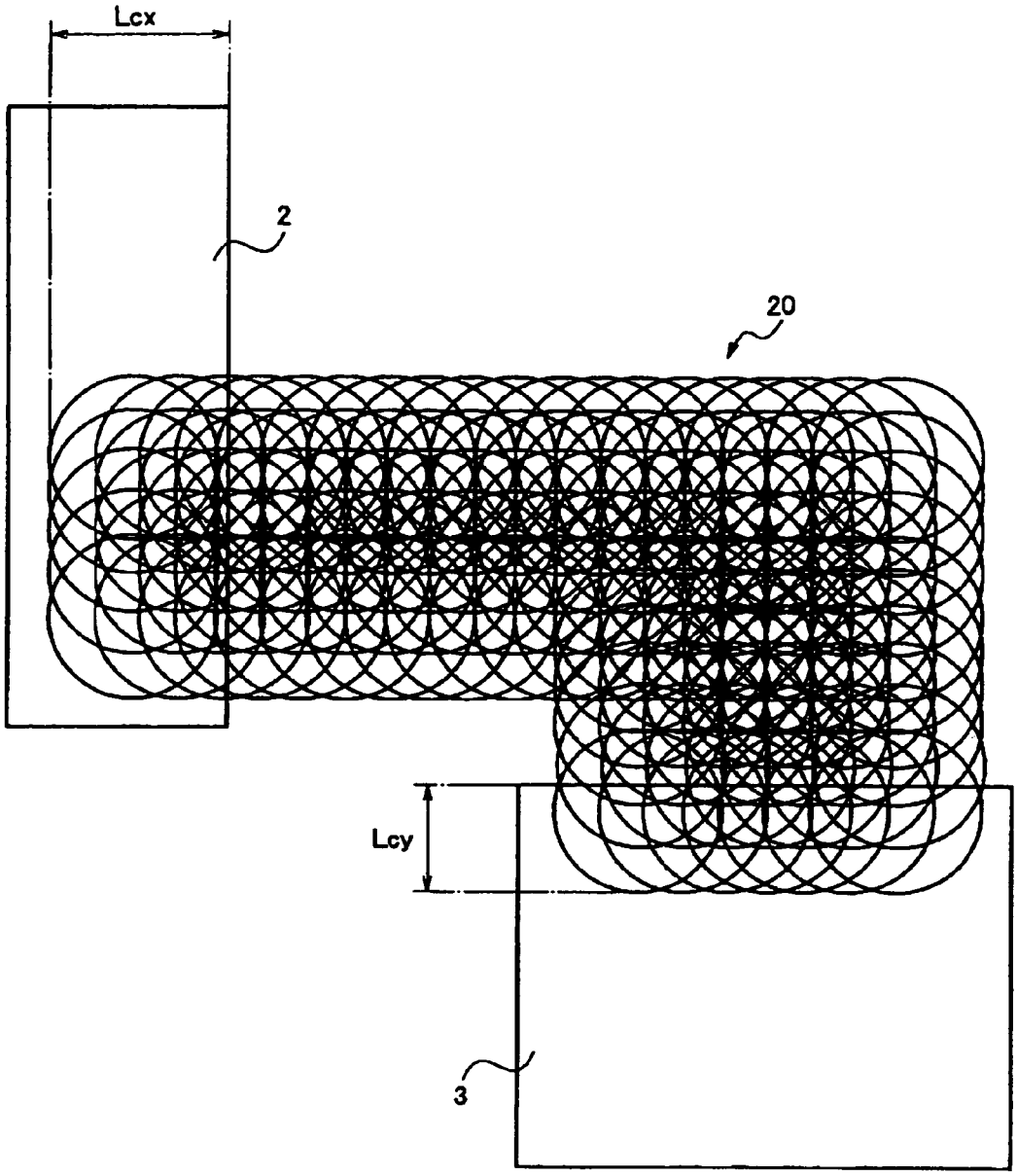
FIG. 18 is a diagram illustrating a formation of the dot pattern.

Another example will be described. In FIG. 17 and FIG. 18, instead of arranging the electron emission part between a pair of the electrodes 2 and 3 in one line as shown in FIG. 16A through FIG. 16D, the electron emission part is othogonalized between the electrodes 2 and 3. However, it is not limited to do so. A configuration shown in FIG. 16A through FIG. 16D can be applied.

FIG. 17 is a diagram illustrating a pattern of two ITO transparent electrodes formed on the substrate. This pattern can be formed by sputtering and etching called a photo lithography technology. FIG. 18 is a diagram illustrating a formation of the dot pattern. After the pattern is formed, as shown in FIG. 18, the dot is applied while displacing by approximate 3 μm the center-to-center distance (dot pitch) and the dot pattern (droplets 42) is formed, by using a discharge head for discharging the solution including the palladium micro-particles so as to obtain a Φ12 μm dot diameter. In this case, a width of the overlap are with one ITO transparent electrode is determined to be approximate 13 μm (Lcx) and a width of the overlap area with another ITO transparent electrode is determined to be approximate 8 μm (Lcy). And more than half one dot is overlapped at the overlap area. By this configuration shown in FIG. 17 and FIG. 18, it is possible to obtain a stable pattern for a long term without the disconnection.

Figure 19:
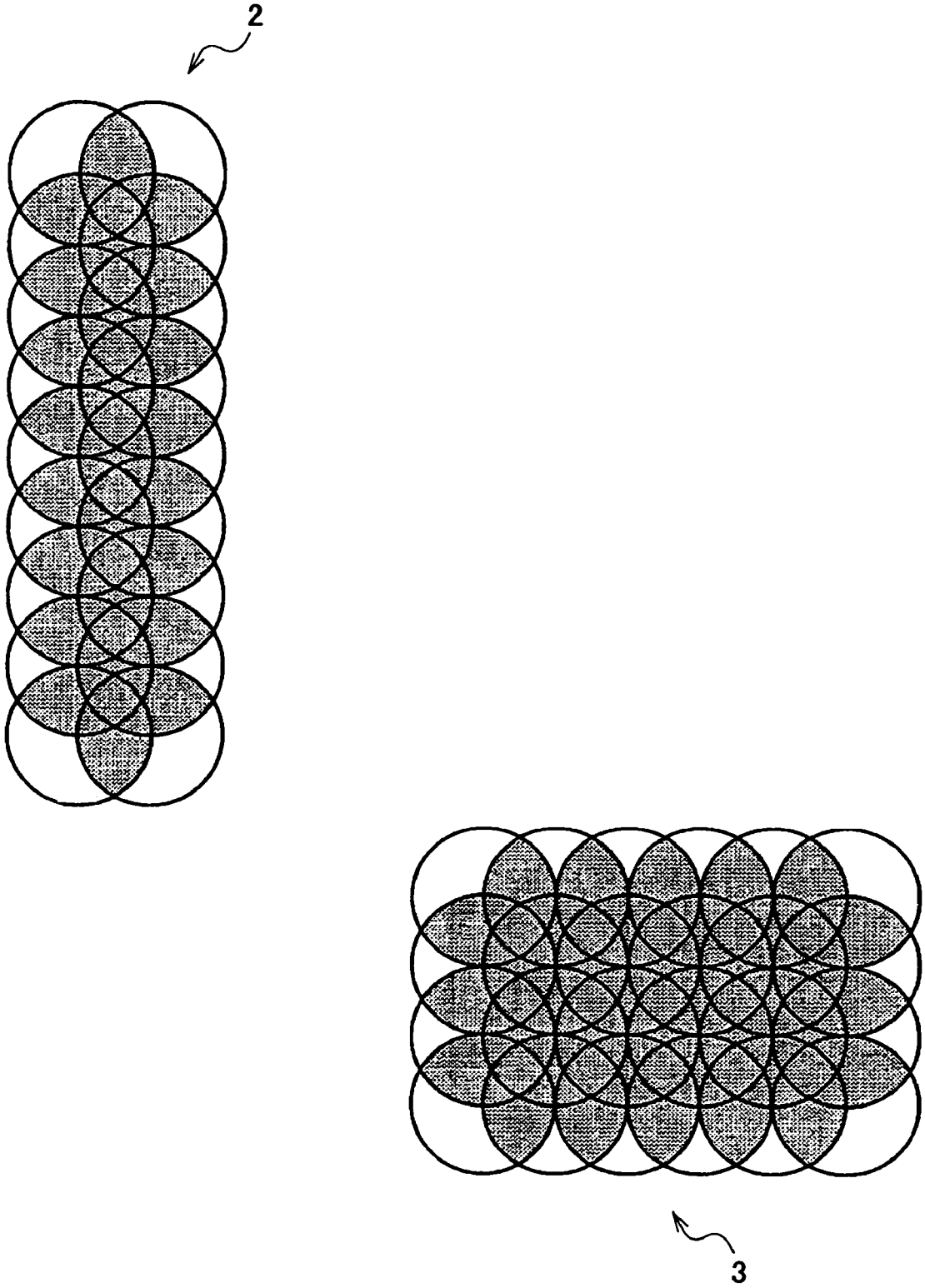
FIG. 19 is a diagram illustrating a dot pattern previously formed on the substrate.

FIG. 19 is a diagram illustrating another example of the dot pattern. In FIG. 19, the pattern of electrodes 2 and 3 are previously formed by the dot pattern formed by jetting the solution including the metal micro-particle material according to the present invention. In this case, Ag is applied as the metal micro-particle. And as shown in FIG. 20, the two electrodes 2 and 3 are connect with the dot pattern (droplets 42) so that the widths (Lcx, Lcy) of the overlap area of the dot pattern is more than half the dot.

Figure 20:
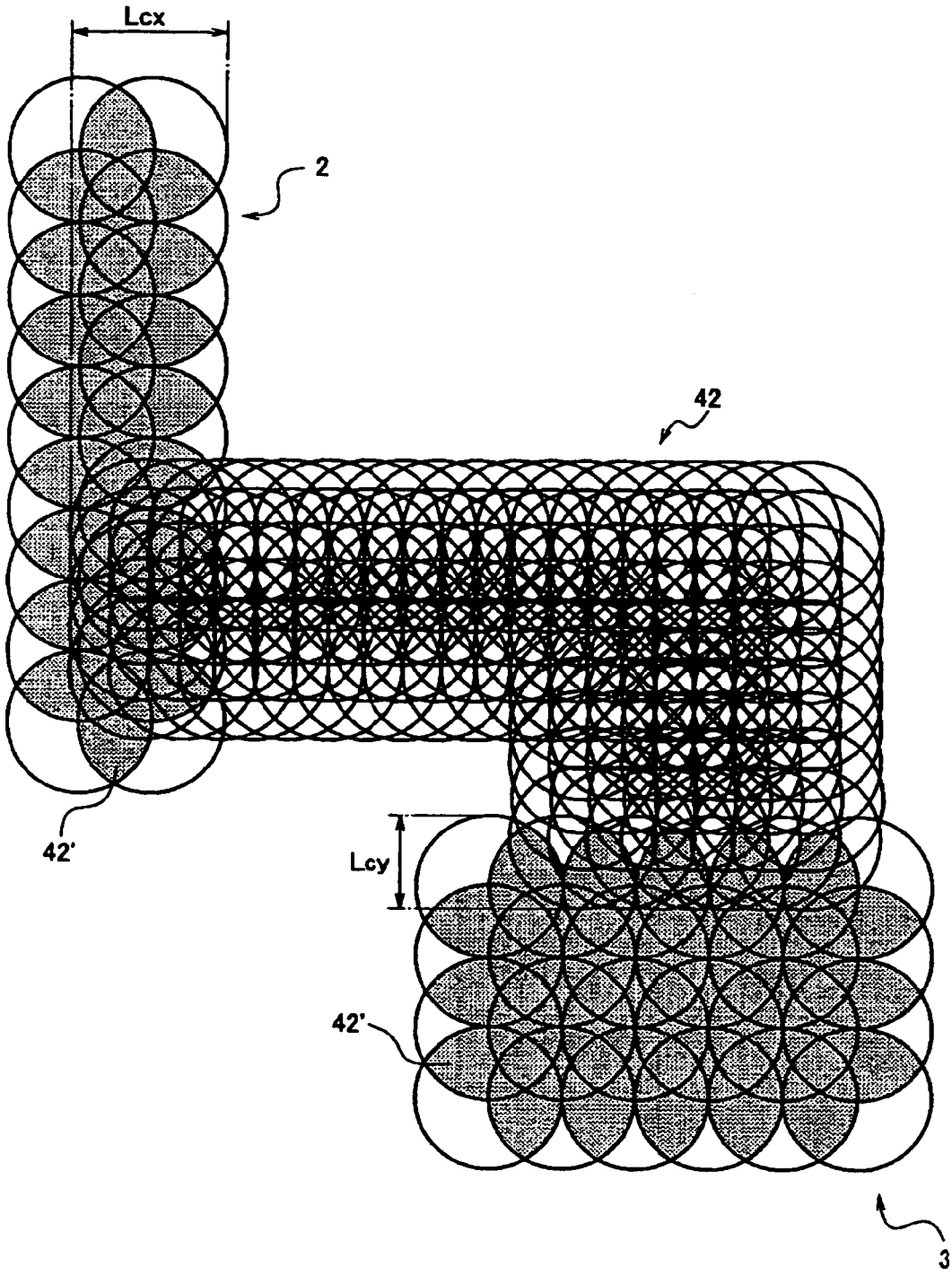
FIG. 20 is a diagram for explaining a method for forming the electron emitting device by arranging dots of the droplets on the dot pattern previously formed on the substrate.

In FIG. 19 and FIG. 20, the previous dot pattern (droplets 42) and the later dot pattern (droplets 42) are illustrated as the same dot diameter. Alternatively, different dot diameters can be applied if necessary. For example, in a case in that the previous dot pattern that is not a thin wiring line is formed in a larger area because of a device configuration, it is effective to use a discharge head having a larger nozzle diameter in order to obtain a larger dot diameter.

In this case, two electrodes 2 and 3 are not limited to be the ITO transparent electrodes that were examined and illustrated to describe the present invention. Alternatively, Al, Au, Cu, or a like material can be properly used. Also, these materials can be used to form the electrode pattern by the film formation, etching, or a like. As described above, the electrode pattern can be formed by jetting a solution including the metal micro-particle material where any one of these metal particles is dispersed.

Figure 21:
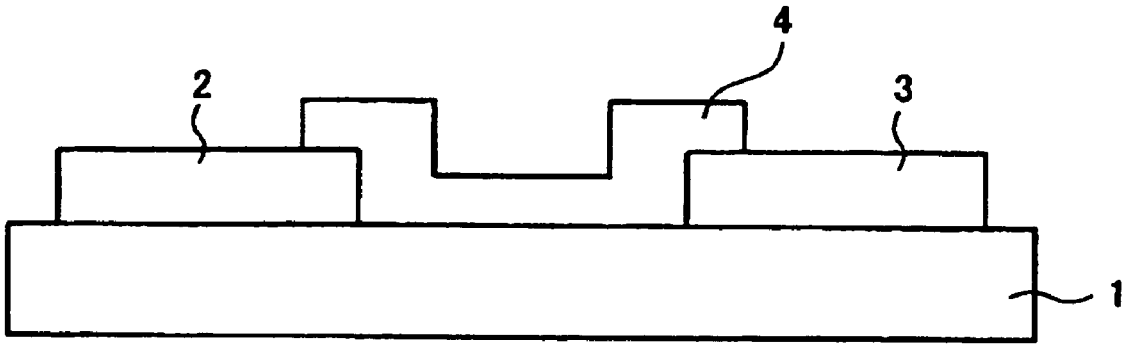
FIG. 21 is a diagram enlarging a state of forming a conductive thin film on the electrodes in FIG. 3B.
Figure 22A:
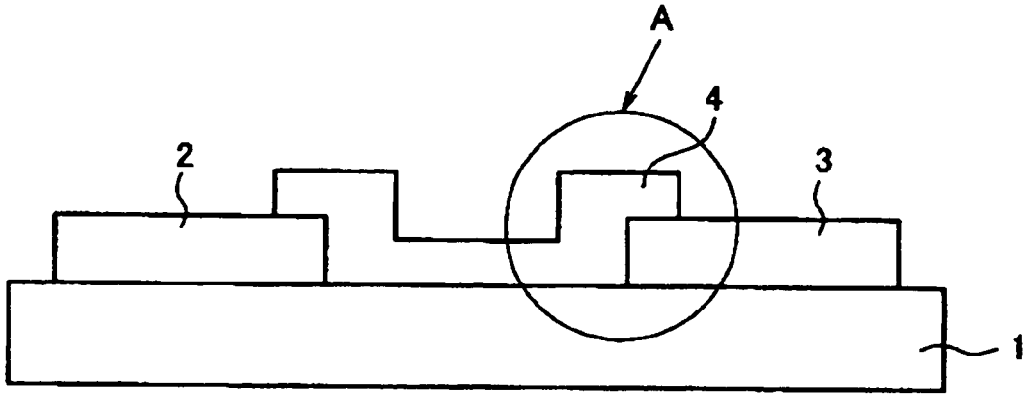
FIG. 22A and FIG. 22B are diagrams showing each area of a pattern of a conductive thin film.
Figure 22B:
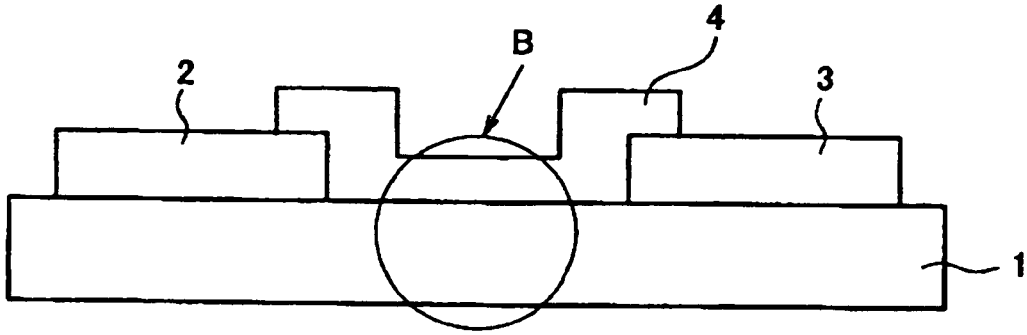

Next, a further feature of the present invention will be described with reference to FIG. 21, FIG. 22A, and FIG. 22B. FIG. 21 is a diagram enlarging the state of forming the conductive thin film 4 on the electrodes 2 and 3 in FIG. 3B. FIG. 22A and FIG. 22B are diagrams showing each area of the pattern of the conductive thin film 4.

In the embodiment of the present invention, the conductive thin film 4 is formed by jetting the solution including the metal micro-particle material between the electrodes 2 and 3 to form the dot pattern, and then drying the dot pattern. In this case, it is necessary to consider a step coverage of the conductive thin film 4 at each edge part of the pattern of the electrodes 2 and 3 previously formed on the substrate 1.

As shown in FIG. 22A, since there is a step in the pattern of the electrode 3 previously formed on the substrate 1 in a part A, when the conductive thin film 4 is formed by jetting the solution in which the metal micro-particles are dispersed, a proper coating cannot be obtained at an edge part. Accordingly, the disconnection can be caused around the edge part. As a result, a durability of the electron emitting device is deteriorated, reliability thereof is lowered, and then the electron emitting device is not practical.

In the embodiment of the present invention, considering these points, the discharge head is controlled to jet the solution in which the metal micro-particles are dispersed to form the conductive thin film 4 so that a thickness of the conductive thin film 4 at the edge is thicker than other areas other than the edge.

In detail, in a case of jetting the solution to the area A, the discharge head applied in the present invention jets the solution by applying a greater input energy for piezoelectric element or the heating element and by a quantity larger than a quantity of the size of the droplet or a jet liquid applied in a case of jetting to an area B sown in FIG. 22B, so that the thickness of the conductive thin film 4 formed at the area A becomes thicker than the other area.

In more detail, for example, the thickness of the electrode pattern is determined to be 300 Å, and the conductive thin film 4 is formed by jetting the solution including the metal micro-particle material and is dried. In a case in that the conductive thin film 4 is dried so that a final thickness of the conductive thin film 4 becomes 200 Å, the discharge head is controlled so that the thickness of the conductive thin film 4 becomes from 300 Å to 500 Å. Accordingly, the step coverage is properly formed, the disconnection is not caused even if the electron emitting device has been uses for a long term, and it is possible to produce the electron emitting device having a higher reliability.

Another example to solve the problem described above will be described. For example, the number of applying a droplet or the solution can be changed differently in a case in that the dot is formed at the area A by jetting the solution and in a case in that the dot is formed at the area B by jetting the solution. That is, after forming the electron emitting device according to the present invention as shown in FIG. 16D, the dot is applied again, two times more, or three times more to the area B at which the step coverage should be considered. That is, at the edge part of the electrode in the connection area after the electronic connection is conducted to the electrodes previously formed on the substrate, the discharge head is controlled to jet the solution as to apply the dot a few times (more than two times).

An experiment conducted in accordance with the above discussion will be described. A pattern shown in FIG. 16D was made as a test pattern in this experiment. The thickness of the ITO electrode patter was 250 Å. By using a discharge head, in which an approximate Φ12 μm dot diameter could be obtained, the dot pattern was formed at a 8 μm arrangement pitch, and the same dot pattern was further applied to the edge part (the area B in FIG. 22B) of the electrode in the connection area. After the dot pattern was dried, the thickness of the dot pattern at the area A in FIG. 22A became 300 Å, and the thickness of the dot pattern at the area B in FIG. 22A became 200 Å. Accordingly, the edge part of the electrode in the connection area was covered thicker, the step coverage could be properly obtained, no disconnection was caused for a long term use, and then the electron emitting device could be obtained at higher reliability in this experiment according to the present invention.

The present invention is related to a technology for manufacturing the electron emitting device. In the embodiment of the present invention, the pattern being remarkably minute such as a few 10 μm to a few μm is not formed by a conventional photo lithography technology, but the electron emitting device group is directly manufactured by a simple apparatus for directly jetting and providing the solution including the metal micro-particle material to the substrate by using the discharge head having minute discharge opening that did not conventionally exist. Accordingly, an expensive manufacturing apparatus used for a semiconductor manufacturing process is not required in this embodiment. Therefore, it is possible to stably manufacture the electron emitting device at lower cost.

In this embodiment of the present invention, after the pattern of the surface conductance type electron emission group is formed and is properly shaped, the electron emitting part 5 is formed by the forming process (see FIG. 3A through FIG. 3C) described later.

The electron emitting part 5 is made up of a crack caused by a high resistance and formed a portion of the conductive thin film 4. And the electron emitting part 5 is made up depending on the film thickness, the film quality, the material, or a forming process condition or a like. A particle diameter being equal to or less than 100 Å may be included inside the electron emitting part 5.

As one example of the forming processing method for providing the conductive thin film 4, a method using an electric process will be described. When a current is applied between the electrodes 2 and 3 by using a power source, a structure of the portion of the conductive thin film 4 is changed and then the electron emitting part 5 is formed. That is, the conductive thin film 4 is locally destroyed, transformed, or degenerated by the electric forming process and the portion which structure is changed is formed. And then this portion becomes the electron emitting part 5.

Figure 23A:
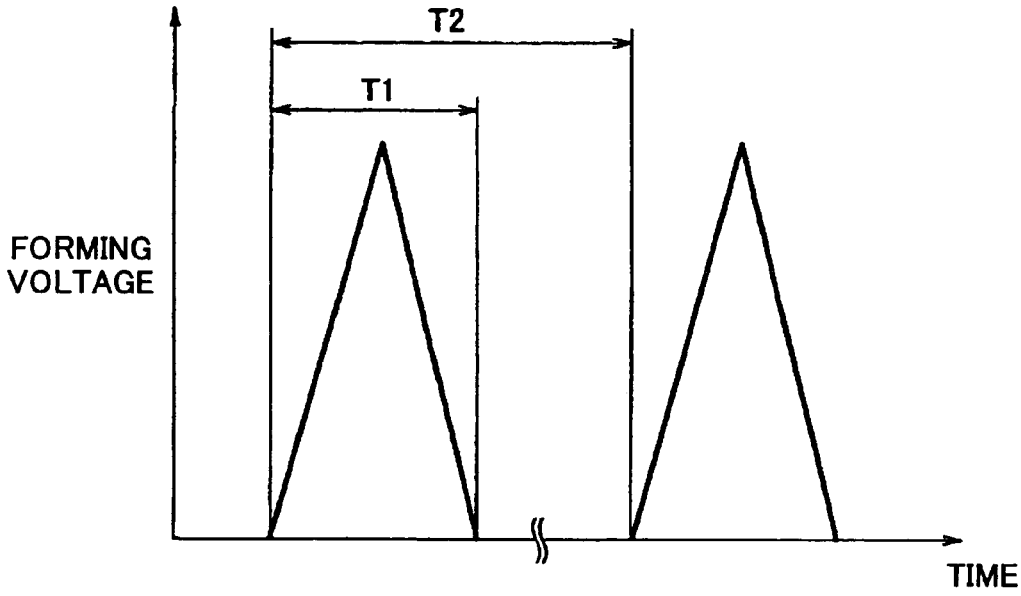
FIG. 23A and FIG. 23B are diagrams showing examples of a voltage waveform of an electric forming process applied in the present invention.
Figure 23B:
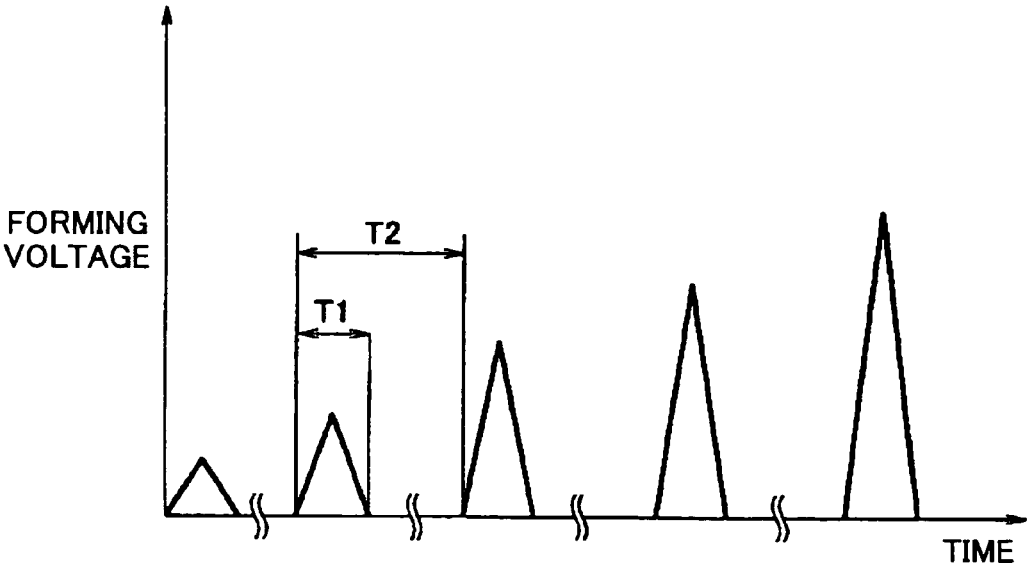

FIG. 23A and FIG. 23B are diagrams showing examples of a voltage waveform of the electric forming process applied in the present invention. A pulse waveform is preferable for the voltage waveform. FIG. 23A shows a case of successively applying a constant voltage pulse at a the pulse wave high value, and FIG. 23B shows a case of applying the voltage pulse while increasing the pulse wave high value. First, the case of successively applying a constant voltage pulse at a pulse wave high value shown in FIG. 23A will be described.

In FIG. 23A, T1 and T2 denote a pulse width and a pulse interval of the voltage waveforms, respectively. T1 is determined to be from 1 μs to 10 ms and T2 is determined to be from 10 μs to 100 ms. A wave high value of a triangular wave (a peek voltage when the electric forming is conducted) is selected based on a form of the surface conduction electron-emitting element. Under this condition, for example, the voltage has been applied for a few seconds or a few ten minutes. The pulse waveform is not limited to the triangular wave. Any waveform such as a rectangle waveform can be use.

In FIG. 23B, T1 and T2 denote the pulse width and the pulse interval of the voltage waveform, respectively. For example, the wave high value of the triangular wave (the peek voltage when the electric forming process is conducted) can be increased by a 0.1V step at each timing.

An end of the electric forming process can be detected by measuring a current while applying the voltage, which does not locally destroy or transform the conductive thin film 4 during the pulse interval T2. For example, a device current applied by applying a 0.1V voltage is measured, a resistance value is obtained, and ten the electric forming process is terminated when the resistance value shows more than 1 MΩ.

It is preferable to conduct a process called an activation process for a device to which the electric forming process is conducted. By conducting the activation process, a device current If and a discharge current Ie are remarkably changed. For example, the activation process can be conducted by repeating to apply the pulse under an atmosphere including gas of an organic material, similar to the electric forming process. For example, the atmosphere can be formed by utilizing an organic gas that remains in the atmosphere in a case of disposing inside a vacuum vessel by using oil diffusion pump or a rotary pump. Also, the atmosphere can be obtained by installing a gas of a proper organic material in vacuum which is sufficiently pumped by an ion pump. A preferable gas pressure of the organic material is selectively determined based an application form described above, a shape of the vacuum vessel, a type of the organic material, or a like.

As an organic material described above, an organic acid type such as alkane, alkene, an alkyne aliphatic carbureted hydrogen type, an aromatic carbureted hydrogen type, an alcohol type, an aldehyde type, a ketone type, an amine type, a phenol type, carboxylic acid, and sulfonic acid can be applied. In detail, it is possible to use saturated hydrocarbon expressed by $CnH_2n+2$ such as metane, ethane, or propane, unsaturated hydrocarbon expressed by a composition formula like $CnH_2n$ such as ethylene, or propylene, benzene, toluene, methanol, formaldehyde, acetaldehyde, acetone, methyl ethyl ketone, methylamine, ethylamine, phenol, formic acid, acetic acid, and propionic acid. By this process, carbon or carbon compound are accumulated on the device from the organic material existing in the atmosphere. Then, the device current If and the discharge current Ie are remarkably changed. The end of the activation process is determined by measuring the device current If and the discharge current Ie. The pulse width, the pulse interval, the pulse wave high value, and the like are selectively determined.

A carbon or a carbon compound is graphite (both monocrystal and polycrystal), or noncrystalline carbon (carbon including noncrystalline carbon and a composite of noncrystalline carbon and the above-described graphite. It is preferable to determine the film thickness to be lower than 500 Å. It is further preferable to determine the film thickness to be lower than 300 Å.

As described above, a stabilizing process is considered to conduct for the electron emitting device. It is preferable to conduct the stabilizing process under a state in that the a partial pressure of the organic material in the vacuum vessel is lower than $1\times10^{-8}$ Torr or preferably lower than $1\times10^{-10}$ Torr. A pressure in the vacuum vessel is lower than $10^{-6}$~$10^{-7}$ Torr or preferably lower than $1\times10^{-8}$ Torr. As a pumping apparatus for pumping inside the vacuum vessel, a apparatus that does not use oil can be used because the oil from the apparatus influences a characteristic of the device. In detail, the pumping apparatus such as a sorption pump, an ion pump, or a like can be used. Furthermore, when the inside of the vacuum vessel, organic material molecules absorbed at an inner wall of the vacuum vessel and the electron emitting device can be easily pumped by heating the entire vacuum vessel. A vacuum pumping condition in a state of heating is determined to heat for more than five hours at from 80° C. to 200° C. It is limited to this vacuum pumping condition. The vacuum pumping condition can be changed based on various states such as the size or the shape of the vacuum vessel, the structure of the electron emitting device, or a like.

The partial pressure of the organic material can be obtained by measuring a partial pressure of the organic molecule including carbon and hydrogen as main components which quantity is from 10 to 200 measured by a mass spectroscope and by integrating those partial pressures. At a activation, the atmosphere at the end of the stabilizing process is maintain. It is not limited to do so. If the organic material is sufficiently eliminated, it is possible to maintain a stable characteristic even if a vacuum degree itself is slightly lowered. By applying such vacuum atmosphere, it is possible to suppress sedimentation of additional carbon or carbon compound. Therefore, as a result, the device current If and the discharge current Ie can be stable.

After the electron emitting device according to the present invention is manufactured and the forming process is conducted as described above, the electron emitting device can be used for an image forming apparatus (display) as described later. However, one problem should be concerned.

This problem should be concerned at the forming process described above or in a case of using as a display. That is, the problem is an abnormal discharge.

Figure 24A:
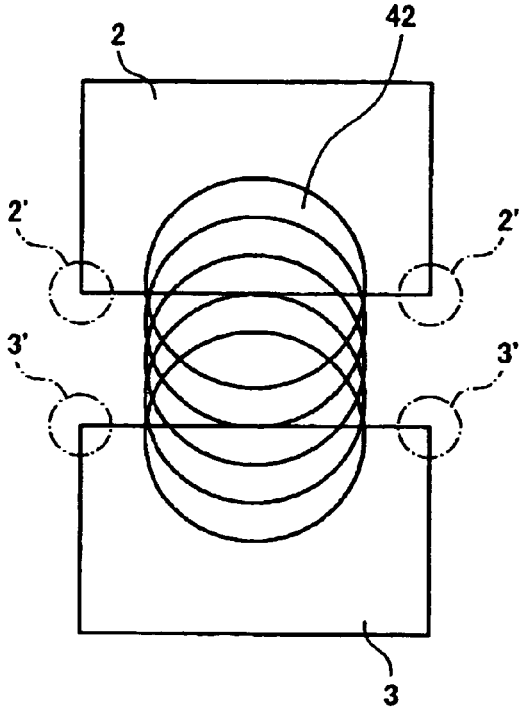
FIG. 24A and FIG. 24B are diagrams showing shapes of the electrodes.
Figure 24B:
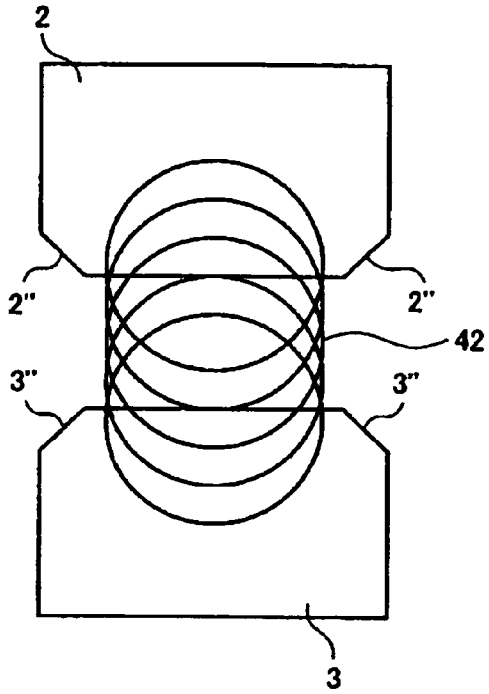

A method for solving the abnormal discharge will be described with reference to FIG. 24A and FIG. 24B. FIG. 24A and FIG. 24B are diagrams showing shapes of the electrodes. In this embodiment of the present invention, as shown in FIG.

24A and FIG. 24B, the electron emitting part is formed by the dot pattern (droplets 42) of the solution including the metal micro-particle material between the plurality of the electrodes 2 and 2 facing each other (for example, two electrodes). Generally, the electrodes 2 and 3 are formed by a rectangle pattern or a combination of rectangle patterns. Because a pattern shape depends on a shape of a photo mask used when the electrode pattern is formed by the photo lithography. A rectangle shape is cheaper to manufacture the electrode pattern. As shown in FIG. 24A, since corner portions 2' and 3' of the two electrodes 2 and 3 facing each other are sharp, an electric field concentration occurs at the corner portions 2' and 3'.

As a result, when a voltage is applied between both two electrodes 2 and 3 by the forming process or when the display is used eventually, the abnormal discharge is caused at the electric field concentration. Accordingly, the forming process cannot be properly conducted or an image quality of the display is deteriorated by the abnormal discharge.

In the embodiment of the present invention, for example, the corner portions where the plurality of the electrodes face each other are cut off to form shapes 2" and 3" as shown in FIG. 24B. FIG. 24B shows a state in that the electrode 2 and 3 are cut off so that the shapes 2" and 3" become c shapes in a case of showing in a mechanical drawing. Alternatively, the electrode 2 and 3 can be cut off so that the shapes 2" and 3" become r shapes.

That is, the photo mask used when the electrode pattern is formed by the photo lithography technology can be made not to be a shape sharpening the corner portions. Alternatively, when the electrodes 2 and 3 are formed by the dot pattern by jetting the solution including the metal micro-particle material as described in FIG. 19, since the dot pattern itself is round and does not have any sharp portion, the electrodes 2 and 3 can automatically have a cut off shape.

A size of the cut off portion is determined to be approximate ½ to ⅕ the dot pattern diameter forming the electron emitting part, that is, to be from c2 μm to c5 μm or from r2 μm to r5 μm. Then, it is possible to form the proper electrodes that do not cause the electric field concentration.

According to the present invention, since sharp portions of the electrode are cut off so that the electric field concentration does not occur, even if the forming process is conducted to the electrode or the electron emitting device is used as the display, it is possible to prevent the abnormal discharge and stably obtain the proper electron emission for a long term. In addition, it is possible to achieve a higher grade image quality of the display.

Next, another method will be described to solve the problem described above will be described with reference to FIG. 25A and FIG. 25B. The pattern formation is controlled so that the corner portions at sides facing the plurality of the electrodes each other are coated by the dot pattern of the solution including the metal micro-particle material.

Figure 25A:
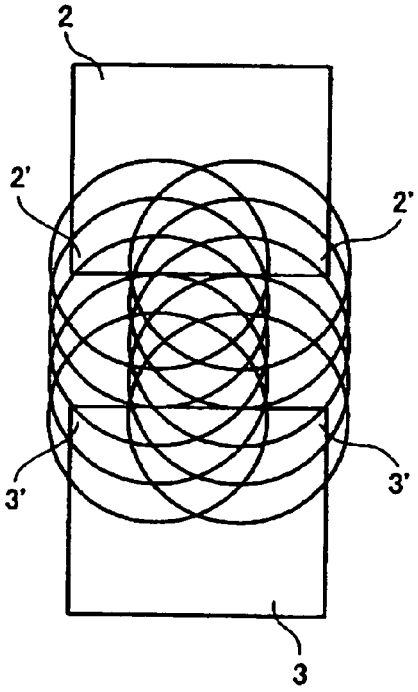
FIG. 25A is a diagram showing a case of forming two dot pattern lines in a longitudinal direction and FIG. 25B is a diagram showing a case of forming one dot pattern line.
Figure 25B:
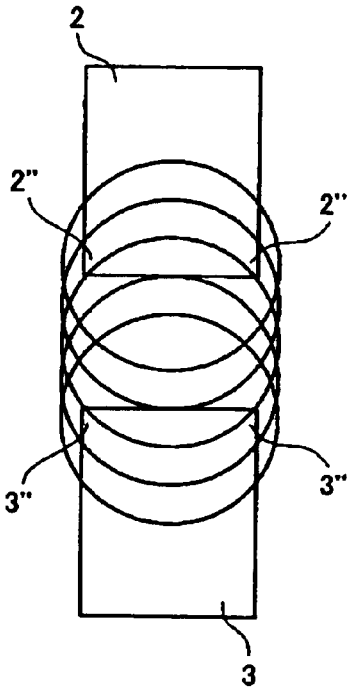

FIG. 25A is a diagram showing a case of forming two dot pattern lines in a longitudinal direction and FIG. 25B is a diagram showing a case of forming one dot pattern line. Both cases in FIG. 25A and FIG. 25B can be applied. In FIG. 25A and FIG. 25B, the sharp portions 2' and 3' of the electrode patterns are coated with the dot pattern of the solution including the metal micro-particle material so that the sharp potions are not disclosed. Accordingly, it is possible to prevent the abnormal discharge caused by the electric field concentration. Then, the forming process can be properly conducted. In a case in that the electron emitting device is used as the display, it is possible to prevent the abnormal discharge and to stably obtain the proper electron emission. In addition, it is possible to provide a higher grade image quality of the display.

Next, another feature of the present invention will be described more with reference to FIG. 26. In the embodiment of the present invention, as described above with reference to FIG. 4 and FIG. 5, the electron emitting device group is formed by jetting and providing the solution including the metal micro-particle material while conducing the relative displacement between the discharge head and the substrate 14. FIG. 16 is a diagram showing the electron emitting device group. In FIG. 16, a group of the electron emitting devices 10 is formed by providing four solution dot patterns the electrodes 2 and 3 formed on the electric source substrate 14 and also between the electrodes 2 and 3 in a longitudinal direction (sub scanning direction).

In this case, a lateral direction is defined as a main scanning direction and a longitudinal direction is defined as a sub scanning direction. In each electron emitting device, each center-to-center distance (arrangement pitch), that is, each of main scanning direction arrangement pitch and sub scanning direction arrangement pitch is considered as an important factor to influence the image quality in a case of using the electron-emitting device according to the present invention as the display.

In the embodiment of the present invention, the display using the electron emitting device is a display that illuminate a fluorescent material by an electron emitted from a crack that is produced between a pair of the electrodes by the forming process. The crack is produced somewhere between the pair of the electrodes and is not always produced at a certain location. That is, the display applying the present invention has a characteristic such that a accuracy of a luminous pixel (picture element) is fluctuated by a distance between the pair of the electrodes at maximum. For example, as shown in FIG. 27, it is possible to arrange a further device between the pair of the devices more than the case shown in FIG. 26, so as to arrange both the main scanning direction arrangement pitch and the sub scanning direction arrangement pitch. However, since there is a fluctuation of an illuminating part originally, such arrangement can not be practical.

That is, in the present invention, it is not practical to determine the center-to-center distance (arrangement pitch) between the devices to be shorter than the distance between the pair of the electrodes. In other words, in the present invention, only in a case in that the distance between the pair of the electrodes is determined to be shorter than the arrangement pitch of the electron emitting device, it is possible to produce an effective display.

Figure 26:
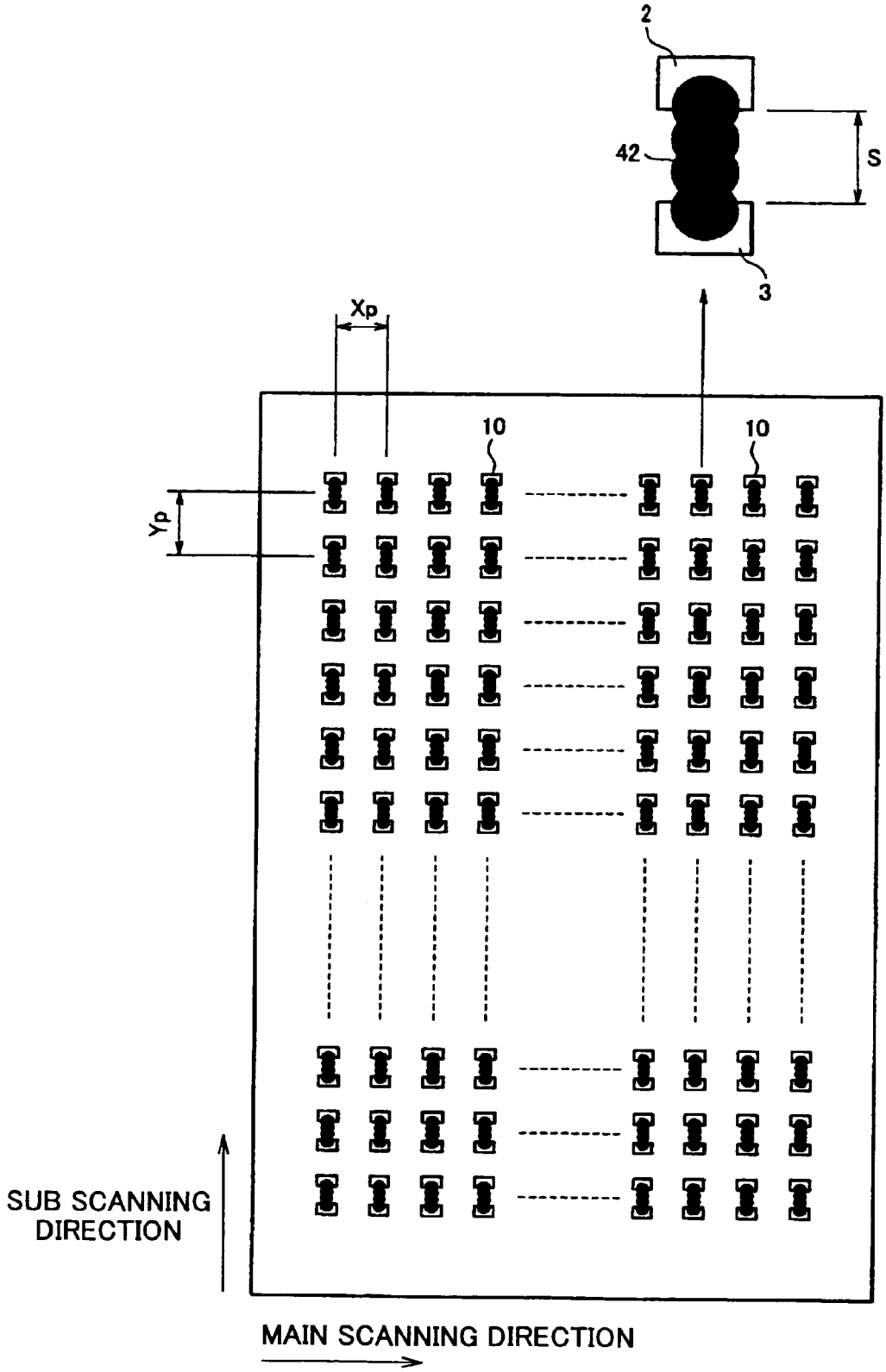
FIG. 26 is a diagram for explaining a definition of the main scanning direction, sub scanning direction and each dimension at the droplet jet to form a group of the tabular surface conduction electron-emitting elements according to the embodiment of the present invention.
Figure 27:
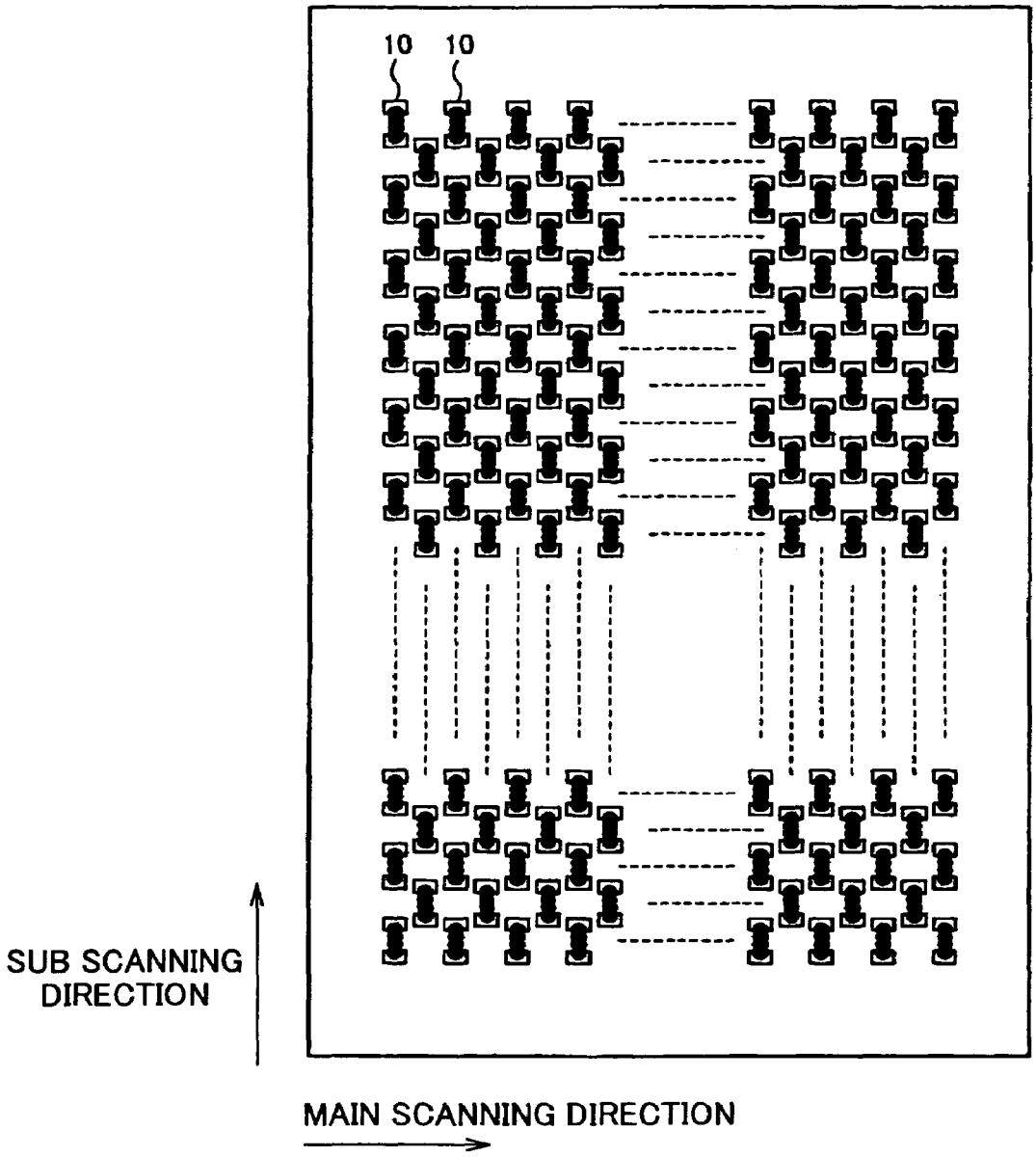
FIG. 27 is a diagram for explaining an ineffectiveness of arranging the group of the tabular surface conduction electron-emitting elements at high precision.

For example, the distance between electrodes (the distance between electrodes is a distance s at a closest approach of the electrodes facing each other as shown in FIG. 26) is determined to be 15 μm, and both the main scanning direction arrangement pitch Xp and the sub scanning direction arrangement pitch Yp are 30 μm). In this case, the electron emitting part is formed by three dot patterns (approximate Φ15 μm). As the discharge head to form this pattern, the discharge head H4 described above (the diameter of the discharge opening Do=Φ10 μm) can be utilized. The discharge head H4 is controlled in that drive voltage for jetting the solution is 15V and the drive pulse width is 2.5 μs. Also, the solution including the palladium micro-particles described above can be used. In addition, in order to precisely conduct the device formation at the main scanning direction arrangement pitch and the sub scanning direction arrangement pitch, it can be realized by conducting the relative displacement between the discharge head and the substrate at higher precision by using the manufacturing apparatus shown in FIG. 5.

In another example, the distance between the electrodes is 30 μm, and both the main scanning direction arrangement pitch and the sub scanning direction arrangement pitch are 50 μm. In this case, the electron emitting part is formed by five dot patterns (the diameter of the pattern is approximate Φ20 μm). As the discharge head to form this pattern, the discharge head H3 described above (the diameter of the discharge opening Do=Φ15 μm) can be utilized. The discharge head H3 is controlled in that the drive voltage for jetting the solution is 13.5V, and the drive pulse width is 3 μs. The solution including the palladium micro-particles described above is used. In order to precisely conduct the device formation by the main scanning direction arrangement pitch and the sub scanning direction arrangement pitch, it can be realized by conducting the relative displacement between the discharge head and the substrate at higher precision by using the manufacturing apparatus shown in FIG. 4 or FIG. 5.

The discharge head of thermal jet (bubble jet™) is illustrated in this example. Alternatively, as the discharge head, a discharge head applying the piesojet using a piezoelectric element, a charge control (a continuous current method), or a like can be used.

Next, the image forming apparatus according to the present invention will be described. Various arrangement of the electron emitting device of an electron-emitting device used for the image forming apparatus. First, a plurality of the electron emitting devices arranged in parallel are connected at both ends, and the plurality of the electron emitting devices are arranged in rows (a row direction). In an orthogonal direction (a column direction) of these wirings, control electrodes are arranged above the electron emitting devices (called grid). Then, in such arrangement (an echelon arrangement), an electron from the electron emitting device is controlled to activate. Alternatively, the electron emitting devices are arranged in an x direction and a y direction such as a matrix, one side of electrodes of the plurality of the electron emitting devices arranged in the same row is connected to wirings in common in the x direction, and another side of the electrodes of the plurality of the electron emitting devices are connected in common in the y direction. This is called simple a matrix arrangement.

Figure 28:
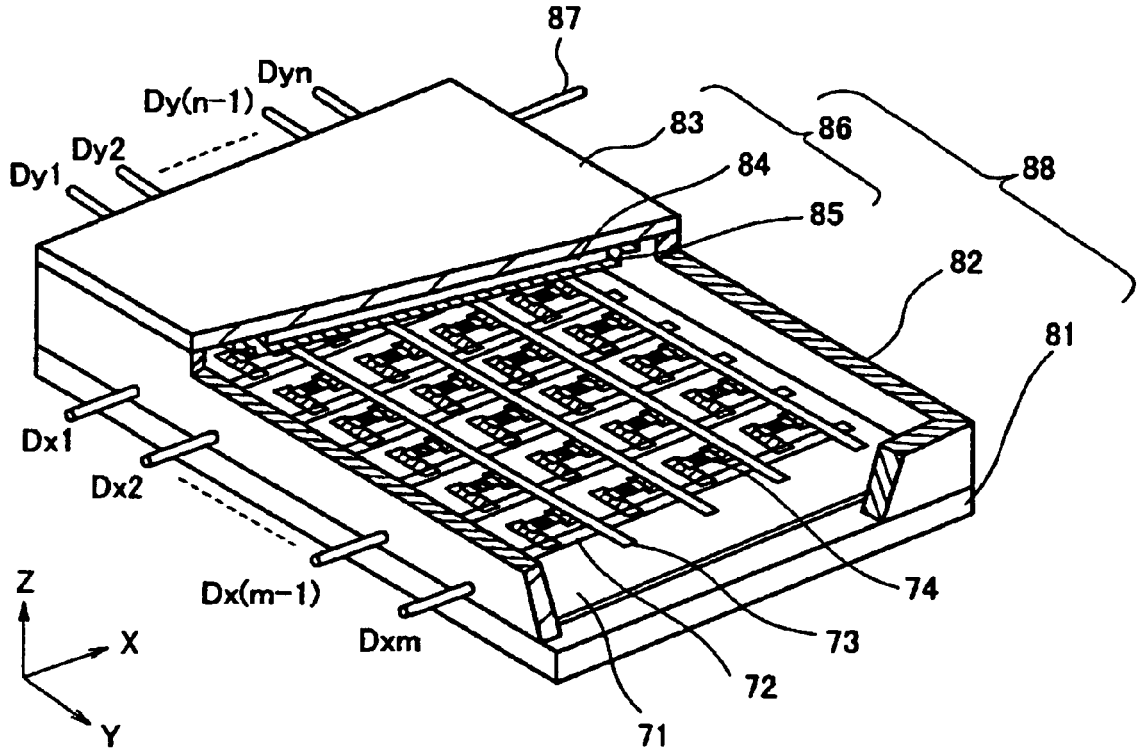
FIG. 28 is a diagram illustrating a basic configuration of a display panel of an image forming apparatus applying a matrix arrangement type electron-emitting device to which the present invention can be applied.

Next, an image forming apparatus using electron source of the simple matrix arrangement will be described. FIG. 28 is a diagram illustrating a basic configuration of a display panel of an image forming apparatus applying a matrix arrangement type electron-emitting device to which the present invention can be applied. FIG. 28, 71 denotes a electron source substrate where an electron emitting devices 74 are formed, 81 denotes a support member, and 86 denotes a face plate where a fluorescent screen 84 and a metalized screen 85 are formed at an inside surface of a substrate 83. A frit glass or a like is applied to a rear plate 81, the support member 82, and face plate 86, and then the rear plate 81, the support member 82, and face plate 86 are adhered by burning at 400° C. to 500° C. for more 10 minutes to make an envelope 88.

The envelope 88 is made up of the face plate 86, the support member 82, and the rear plate 81. Since the rear plate 81 is provided to mainly reinforce the electron-emitting device 71, if the electron-emitting device 71 itself has sufficient strength, the rear plate 81 is not required. The support member 82 may be directly adhered to the electron-emitting device 71, and the envelope 88 may be made up of the face plate 86, the support member 82, and the electron-emitting device 71. Alternatively, by providing a withstand atmosphere pressure support member called a spacer between the face plate 86 and rear plate 81, it is possible to configure the envelope 88 having sufficient strength against the atmosphere pressure.

In any configuration of the envelope 88, since the face plate 86 configures the image forming apparatus (image displaying apparatus) by integrating the electron-emitting device 71 and layers.

Figure 29A:
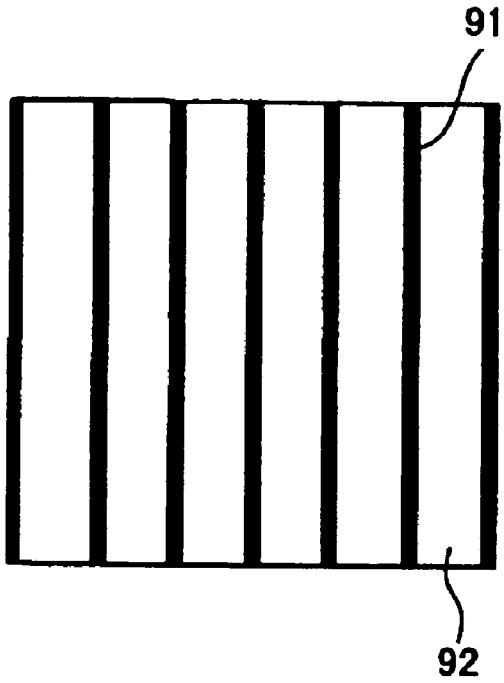
FIG. 29A and FIG. 29B are diagrams showing a configuration of a fluorescent screen used in the image forming apparatus to which the present invention can be applied.
Figure 29B:
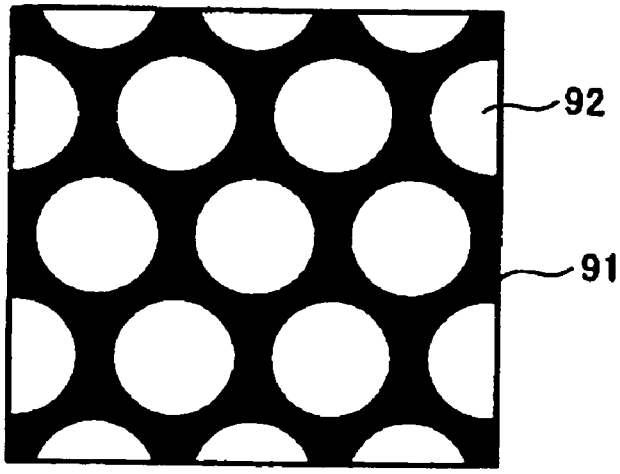

FIG. 29A and FIG. 29B are diagrams showing a configuration of a fluorescent screen used in the image forming apparatus to which the present invention can be applied. In FIG. 29A, a fluorescent screen of a black stripe type is shown. In FIG. 29B, a fluorescent screen of the black matrix type is shown. In FIG. 29A and FIG. 29B, 91 denotes a black conductive member and 92 denotes a fluorescent material.

The fluorescent screen 84 is made up of only a fluorescent material in a case of monochrome. In a case of a color fluorescent screen, the fluorescent screen 84 is made up of a black conductive member 91 called a black stripe or a black matrix. By providing the black stripe or the black matrix, borders among fluorescent materials 92 of three primary colors become black in case of the color fluorescent screen, so that it is possible to suppress obviousness of a color mixture and to suppress deterioration of a contrast caused by an outer lit reflex by the fluorescent screen 84. As a material of the black stripe, a material including a black lead as a main composition is generally used. Alternatively, any material, which is conductive and have less optical transmission and reflex, can be applied.

In the present invention, in order to configure the image displaying apparatus, the black stripe direction of the fluorescent material 92 or two directions being an orthogonal each other in the black matrix, and two directions of the electron emitting devices 74 being orthogonal each other are determined to be arranged in parallel. In addition, the fluorescent material 92 corresponds to each of the electron emitting devices 74. In the image displaying apparatus having this configuration, since directions of a matrix and the locations are corresponded to each other, the image displaying apparatus having a remarkable high image quality can be realized.

As a method for applying the fluorescent material to the substrate 83 being a glass, regardless of monochrome or color, a precipitation method or a printing method can be used. Also, the metalized screen 85 is generally provided at an inner surface of the fluorescent screen 84 (FIG. 28) The metalized screen 85 improves a brightness by conducting a specular reflexion toward the face plate 86 by a light coming to the inner surface of the luminescence of the fluorescent material, applies an electoric beam acceleration voltage as an electrode, and to protects the fluorescent material from a damage caused by a collision of a negative ion occurred inside the envelope 88. After the fluorescent screen 84 is produced, a smoothing process (called generally a filming process) is conducted and then Al is layered by conducting a vacuum deposition so as to produce the metalized screen 85. In addition, in order to improve a conductivity of the fluorescent screen 84, a transparent electrode (not shown) may be provided outside the fluorescent screen 84 in the face plate 86.

When an adherence is conducted to create the envelop 88 described above, in the case of color, since it is required to correspond each fluorescent materials 92 to each electron emitting device 74, an accurate location adjustment is required. In the present invention, in order to realize the accurate location adjustment, as described above, each fluorescent material 92 is arranged at a location facing each electron emitting device 74. In addition, two directions being orthogonal each other in the matrix of the electron emitting devices 74 and the fluorescent materials 92 are determined to be parallel. In order to obtain a high precision image display apparatus in this configuration, it is recommended to conduct a similar positioning method for the electron-emitting device according to the present invention for this fluorescent material substrate.

The image forming apparatus shown in FIG. 28 can be manufactured as follows. Similar to the above-described stabilizing process, the envelope 88 is pumped by a pumping apparatus that does not use oil such as an ion pump or sorption pump, through an air release pipe (not shown). After achieving an atmosphere in which the organic material of the vacuum degree is sufficiently lowered at approximate $10^{-7}$ Torr, the envelope 88 is sealed. In order to maintain the vacuum degree after the envelope 88 is sealed, a getter process may be conducted. The getter process is to heat a getter arranged at a predetermined location (not shown) in the envelope 88 by a heating method such as a resistance heating method or a high-frequency heating method before of after the envelope 88 is sealed, and to form a deposition film. Ba is generally used as the getter and can maintain, for example, $1\times10^{-5}$ Torr or $1\times10^{-7}$ Torr vacuum degree by an absorption of the deposition film.

According to the present invention, first, in the electron-emitting device manufacturing apparatus for forming a surface conduction electron-emitting element by a conductive thin film, a discharge head of a piezo-jet type using a piezoelectric element has a discharge opening, the diameter of which is equal to or less than $\phi$25 μm. The discharge head jets a solution that includes a metal micro-particle material for forming the conductive thin film, on the area between the electrodes, which are formed on a substrate of the electron-emitting device, as a droplet. A volatile component in a solution dot pattern is vaporized after the droplet is jetted on the substrate so that a solid content is remained on the substrate. The solution having micro-particle dispersed in liquid satisfies a relationship of $0.0002 \leqq Dp/Do \leqq 0.01$ where Dp denotes a diameter of the metal micro-particle and Do denotes a diameter of the discharge opening. it is possible to form the electron emitting device having a minute and favorable pattern and it is possible to realize a novel electron-emitting device manufacturing apparatus that can be stably used without any clogging for a long time when the solution is jetted.

Second, in the electron-emitting device manufacturing apparatus for forming a surface conduction electron-emitting element by a conductive thin film, a discharge head of a thermal-jet type using a heating element has a discharge opening, the diameter of which is equal to or less than $\phi$25 μm. The discharge head jets a solution that includes the metal micro-particle material for forming the conductive thin film, on the area between the electrodes, which are formed on a substrate of the electron-emitting device, at a speed between 6 m/s and 18 m/s. A volatile component in a solution dot pattern is vaporized after the droplet is jetted on the substrate so that a solid content is remained on the substrate. The solution having micro-particle dispersed in liquid satisfies a relationship of $0.0002 \leqq Dp/Do \leqq 0.01$ where Dp denotes a diameter of the metal micro-particle and Do denotes a diameter of the discharge opening. it is possible to form the electron emitting device having a minute and highly precise pattern and it is possible to realize a novel electron-emitting device manufacturing apparatus that can be stably used without clogging for a long term when the solution is jetted.

Third, in the electron-emitting device manufacturing apparatus, t the solution is jetted such that the solution accompanies a plurality of minute droplets during flying. Therefore, it is possible to stable jet the solution at high speed, to obtain high precise dropped location on the substrate, and to manufacture the electron-emitting device.

Fourth, in the electron-emitting device manufacturing apparatus, the apparatus jets the solution while moving the discharge head and the substrate relatively with a relative movement velocity equal to or less than one third of a jet velocity of the solution. Therefore, it is possible to form a high precise and favorable dot of the solution and to manufacture the electron-emitting device having a high grade electron emission.

Fifth, in the electron-emitting device manufacturing apparatus, the metal micro-particle is a material softer than material that forms the discharge opening. Therefore, it is possible to realize a novel electronic source that can be stably used for a longtime in that a discharge performance is not deteriorated because the discharge opening of the discharge head is scratched or worn out.

Sixth, with regard to the solution including metal micro-particle material used for an electron-emitting device manufacturing apparatus that manufactures a surface conduction electron-emitting element by a conductive thin film, the electron-emitting device manufacturing apparatus has a discharge head of a piezo-jet type using a piezoelectric element, and the discharge head has discharge opening, the diameter of which is equal to or less than $\phi$25 μm, and the discharge head jets the solution including the metal micro-particle material for forming the conductive thin film on the area between the electrodes. The electrodes are formed on the substrate of the electron-emitting device, as a droplet, and a volatile component in a solution dot pattern is vaporized after the droplet is jetted on the substrate so that a solid content is remained on the substrate. The solution having micro-particle dispersed in liquid satisfies a relationship of $0.0002 \leqq Dp/Do \leqq 0.01$ where Dp denotes a diameter of the metal micro-particle and Do denotes a diameter of the discharge opening. Therefore, it is possible to form the electron emitting device having a minute and favorable pattern and to realize a novel solution including the metal micro-particles that can be stably used without clogging for a ling time when the solution is jetted.

Seventh, with regard to the solution including metal micro-particle material used for an electron-emitting device manufacturing apparatus that manufactures a surface conduction electron-emitting element by a conductive thin film, the electron-emitting device manufacturing apparatus having a discharge head of a thermal-jet type using a heating element. The discharge head has a discharge opening, the diameter of which is equal to or less than $\phi$25 μm, and jetting a solution including the metal micro-particle material for forming the conductive thin film, and the discharge head jets the solution on the area between the electrodes, which are formed on a substrate of the electron-emitting device, at a speed between 6 m/s and 18 m/s. A volatile component in a solution dot pattern is vaporized after the droplet is jetted on the substrate so that a solid content is remained on the substrate. The solution having micro-particle dispersed in liquid satisfies a relationship of $0.0002 \leqq Dp/Do \leqq 0.01$ where Dp denotes a diameter of the metal micro-particle and Do denotes a diameter of the discharge opening. Therefore, it is possible to form the electron emitting device having a minute and favorable pattern and to realize a novel solution including the metal micro-particles that can be stably used without clogging for a ling time when the solution is jetted.

Eighth, in the solution including metal micro-particles used in the electron-emitting device manufacturing apparatus, the metal micro-particle is a material softer than member materials configuring the discharge openings. Therefore, it is possible to realize a novel solution including a metal micro-particle material that can be stably used for a longtime in that a discharge performance is not deteriorated because the discharge opening of the discharge head is scratched or worn out.

Ninth, the electron-emitting device includes a substrate and a surface conduction electron-emitting element formed on the substrate by a conductive thin film, said conductive thin film is formed by jetting solution including a metal micro-particle material on the area between the electrodes, which are formed on a substrate of the electron-emitting device, and vaporizing a volatile component in a solution dot pattern after the droplet of solution is jetted on the substrate so that a solid content is remained on the substrate. A diameter of the metal micro-particle in the solution is equal to or less than a roughness of a surface of the substrate where a dot pattern is formed, and a thickness of the dot pattern is greater than the roughness of the surface of the substrate. Therefore, it is possible to realize an electron-emitting device conducting a preferable electron emission so as to form the electron emitting device at higher grade.

Tenth, in the electron-emitting device, the electron-emitting part is formed at a density equal to or less than Ld/2 where Ld denotes a dot diameter when a single dot is formed when an electron-emitting part of the surface conduction electron-emitting element is formed by combining the dot patterns, and combination of which is made by arranging a plurality of dots in one line. Therefore, it is possible to obtain an electron emitting device that is strong and reliable with respect to a disconnection.

Eleventh, in the electron-emitting device, an electron-emitting part of the surface conduction electron-emitting element is formed by the combination of the dot patterns, and the dot pattern is electrically connected to the electrodes such that the dot pattern covers the electrodes with more than half dot of the dot pattern in the connection area of the dot pattern and the electrodes. Therefore, it is possible to obtain an electron emitting device that is strong and reliable with respect to a disconnection.

Twelfth, in the electron-emitting device, an electron-emitting part of the surface conduction electron-emitting element is formed by the combination of the dot patterns, and the dot pattern is electrically connected to the electrodes such that the thickness of the dot pattern in the connection area is thicker than the thickness of the dot pattern of the other area. Therefore, a step coverage can be improved, and it is possible to obtain an electron emitting device that is strong and reliable with respect to a disconnection.

Thirteenth, in the electron-emitting device, an electron-emitting part of the surface conduction electron-emitting element is formed by the combination of the dot patterns, and the dot pattern is electrically connected to the electrodes such that a plurality of the dot pattern are jetted and superimposed on a connection area of the dot pattern and the electrodes. Therefore, it is possible to obtain an electron emitting device that is strong and reliable with respect to a disconnection.

Fourteenth, in the electron-emitting device, the electrode is formed by a rectangle pattern or a combination of rectangle patterns, and a corner portion of the rectangle pattern is cut off. Therefore, it is possible to obtain the electron-emitting device having an electron emitting device at a high quality and a higher reliability so that an abnormal discharge is not caused.

Fifteenth, in the electron-emitting device, the electrode is formed by a rectangle pattern or a combination of rectangle patterns, and a corner portion of the electrode that faces with another electrode is cut off. Therefore, it is possible to obtain the electron-emitting device having an electron emitting device at a high quality and a higher reliability so that an abnormal discharge is not caused.

Sixteenth, in the electron-emitting device, the electrode is formed by a rectangle pattern or a combination of rectangle patterns, and a corner portion of the rectangle pattern is coated with the dot pattern. Therefore, it is possible to obtain the electron-emitting device having an electron emitting device at a high quality and a higher reliability so that an abnormal discharge is not caused.

Seventeenth, in the electron-emitting device, the electrode is formed by a rectangle pattern or a combination of rectangle patterns, and a corner portion of the electrode that faces with another electrode is coated with the dot pattern. Therefore, it is possible to obtain the electron-emitting device having an electron emitting device at a high quality and a higher reliability so that an abnormal discharge is not caused.

Eighteenth, in the electron-emitting device, a plurality of the surface conduction electron-emitting elements are formed on the substrate as a device group with a matrix form, and a distance between the electrodes of each pair of the surface conduction electron-emitting elements is shorter than an arrangement pitch of the device group. Therefore, it is possible to obtain the electron-emitting device having a high precise electron emitting device.

Nineteenth, the image displaying apparatus includes an electron-emitting device that includes a substrate and a surface conduction electron-emitting element formed on the substrate by a conductive thin film, said conductive thin film is formed by jetting solution including a metal micro-particle material on the area between the electrodes, which are formed on the substrate of the electron-emitting device, and vaporizing a volatile component in solution dot pattern after the droplet of solution is jetted on the substrate so that a solid content is remained on the substrate, and a diameter of the metal micro-particle in the solution is equal to or less than a roughness of a surface of the substrate where a dot pattern is formed, and a thickness of the dot pattern is greater than the roughness of the surface of the substrate, and a face plate arranged to be facing the electron-emitting device, and said face plate mounting fluorescent material and having a shape and size substantially the same with that of the electron-emitting device substrate. Therefore, it is possible to realize the image display apparatus having a high quality, a high precision, a high reliability, a high image quality, a high grade, and a high durability.

The present invention is not limited to the specifically disclosed embodiments, and variations and modifications may be made without departing from the scope of the present invention.

The present application is based on the Japanese priority applications No. 2002-308144 filed on Oct. 23, 2002 and No. 2003-331325 filed on Sep. 24, 2003, the entire contents of which are hereby incorporated by reference.

What is claimed is:

1. An electron-emitting device manufacturing apparatus for forming a surface conduction election-emitting element by a conductive thin film, said electron-emitting device manufacturing apparatus comprising:

a discharge head of a piezo-jet type using a piezoelectric element, said discharge head having discharge opening and jetting a solution that includes micro-particle material for forming the conductive thin film, and said discharge head jetting the solution on the area between the electrodes formed on a substrate of the electron-emitting device, at a speed between 6 m/s and 18 m/s and in a range from a few picoliters to a few tens of picoliters and vaporizing a volatile component in a solution dot pattern after the droplet is jetted on the substrate so that a solid content remaining on the substrate as its thickness is in a range from 10 Å to 500 Å, wherein the solution having micro-particle dispersed in liquid satisfies a relationship of $0.0002 \leqq Dp/Do \leqq 0.01$ where Dp denotes a diameter of the micro-particle and Do denotes a diameter of the discharge opening.

2. The electron-emitting device manufacturing apparatus as claimed in claim 1, wherein the micro-particle is a material softer than material that forms the discharge opening.

3. An. electron-emitting device manufacturing apparatus for forming a surface conduction electron-emitting element by a conductive thin film, said electron-emitting device manufacturing apparatus comprising:

a discharge head of a thermal-jet type using a heating element, said discharge head having a discharge opening and jetting a solution that includes micro-particle material for forming the conductive thin film, and said discharge head jetting the solution on the area between the electrodes formed on a substrate of the electron-emitting device, at a speed between 6 m/s and 18 m/s and in a range from a few picoliters to a few tens of picoliters and vaporizing a volatile component in a solution dot pattern after the droplet is jetted on the substrate so that a solid content remaining on the substrate as its thickness is in a range from 10 Å to 500 Å, wherein the solution having micro-particle dispersed in liquid satisfies a relationship of $0.0002 \leqq Dp/Do \leqq 0.01$ where Dp denotes a diameter of the micro-particle and Do denotes a diameter of the discharge opening.

4. The electron-emitting device manufacturing apparatus as claimed in claim 3, wherein the solution is jetted such that the solution accompanies a plurality of minute droplets during flying.

5. The electron-emitting device manufacturing apparatus as claimed in claim 4, wherein the apparatus jets the solution while moving the discharge head and the substrate relatively with a relative movement velocity equal to or less than one third of a jet velocity of the solution.

6. The electron-emitting device manufacturing apparatus as claimed in claim 3, wherein the apparatus jets the solution while moving the discharge head and the substrate relatively with a relative movement velocity equal to or less than one third of a jet velocity of the solution.

7. The electron-emitting device manufacturing apparatus as claimed in claim 3, wherein the micro-particle is a material softer than material that forms the discharge opening.

* * * * *